US006352061B2

(12) United States Patent
Takahashi

(10) Patent No.: US 6,352,061 B2
(45) Date of Patent: Mar. 5, 2002

(54) CONTROL DEVICE FOR A VARIABLE VALVE TIMING MECHANISM OF AN ENGINE

(75) Inventor: Shunichi Takahashi, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/772,827

(22) Filed: Jan. 30, 2001

(30) Foreign Application Priority Data

Feb. 3, 2000 (JP) ..... 2000-3082751

(51) Int. Cl.[7] ..... F01L 1/34; F01L 13/00

(52) U.S. Cl. ..... 123/90.15; 123/90.17; 477/107

(58) Field of Search ..... 123/90.15, 90.16, 123/90.17, 90.18; 477/107, 109

(56) References Cited

U.S. PATENT DOCUMENTS 4,917,057 A * 4/1990 Seki ..... 123/90.16
5,056,378 A * 10/1991 Aimone et al. ..... 477/109
5,184,577 A * 2/1993 Kato et al. ..... 123/90.15
5,280,770 A * 1/1994 Satou et al. ..... 123/90.15
5,679,094 A * 10/1997 Nakamura et al. ..... 477/111

* cited by examiner

*Primary Examiner*—Weilun Lo
(74) *Attorney, Agent, or Firm*—Martin A. Farber

(57) ABSTRACT

An engine control device with a variable valve timing mechanism is provided for preventing an abrupt engine output fluctuation in the process of transmission operation or lock up clutch switching operation in an engine with the variable valve timing mechanism, and a torque shock is restrained accordingly. An ECU determines whether or not an automatic transmission is in the process of transmission operation or whether or not a lock up clutch is in the process of switching. If the automatic transmission is in the process of transmission operation or the lock up clutch is in the process of switching, a target valve timing is not updated, and the valve timing at the time is held. Thus, the operation of a VVT in the process of transmission operation of the automatic transmission or the switching operation of the lock up clutch is stopped, so that an engine output fluctuation caused by change in the valve timing can be prevented and the torque shock can be restrained.

4 Claims, 14 Drawing Sheets

ADVANCED ANGLE STATE

DELAYED ANGLE STATE

VVT CONTROL ROUTINE
S11
AT TRANSMISSION IN PROGRESS ?
YES
NO
S12
LOCK UP CLUTCH SWITCHING IN PROGRESS ?
YES
NO
S14
FCH=1
YES
NO
S15
CCH≧CSET
NO
YES
S13
FCH←1
S17
FCH←0
S16
CCH←CCH+1
S18
CCH←0
VTTGT←TBL (Tp, NE)
S19
REAL VALVE TIMING VT CALCULATED BASED ON OUTPUTS OF CAM POSITION SENSOR, CRANK ANGLE SENSOR
S20
IVT←IVTH+K(VTTGT-VT)
S21
IVT SET
S22
RTS

CONTROL DEVICE FOR A VARIABLE VALVE TIMING MECHANISM OF AN ENGINE

BACKGROUND OF THE INVENTION

The present invention relates to a control device for a variable valve timing mechanism of an engine which changes the opening valve timing (valve timing) of at least one of an intake valve and an exhaust valve of the engine depending on an operation state of the engine. The invention more specifically relates to a control device for a variable valve timing mechanism of an engine which stops the operation of the variable valve timing mechanism to restrain a shock caused by a torque fluctuation in at least one of a case when an automatic transmission is in the process of transmission operation and a case when a lock up clutch is in the process of switching.

In recent years, engines with a variable valve timing mechanism which changes the valve timing of at least one of the intake valve and the exhaust valve in the engine depending on the engine operation state have been widely used. Such an engine controls as required the valve overlap period during which both valves are open at the same time, so that a combustion form suitable for the engine operation state can be implemented and the combustion efficiency can be improved.

Meanwhile, conventionally, it has been widely practiced to provide a vehicle having an automatic transmission with a so-called lock up clutch which engages/disengages an impeller and a turbine with/from a torque converter as required and thus mechanically couple the input side and the output side of the automatic transmission. Thus, the transmission loss in the torque converter is restricted to efficiently transmit driving force, so that the fuel efficiency is improved.

The engine with a variable valve timing mechanism sometimes employs the manner of control in which the valve timing is angularly delayed before cutting fuel, and vibration caused by the fuel cutting at the time of slow down is restrained. However, such control causes an abrupt output torque fluctuation, and vibration is caused through the body of the vehicle. Therefore, Japanese Patent Laid-Open Publication No. Hei. 8-246938 discloses cooperative control between a variable valve timing mechanism and an automatic transmission. According to the disclosed control, in the slow down state without the necessity of fuel supply, the lock up clutch is engaged followed by angular delay control and then fuel supply is cut, in order to restrain the vibration.

According to the structure disclosed by Japanese Patent Laid-Open Publication No. Hei. 8-232693, when the speed is changed to a low speed step by kick down for example, and the engine speed abruptly increases, the revolution number is previously estimated based on a target transmission ratio in the automatic transmission and the vehicle speed. Then, the advance angle value is corrected as required so that an appropriate valve lift characteristic for the estimated revolution number is attained. Then, the improper operation of the intake/exhaust valves may be prevented and therefore excessive allowance is not provided in a steady state, so that a valve lift appropriate for a driving condition may be provided.

Meanwhile, in a vehicle having an engine with such a variable valve timing mechanism, if there is a change in the valve timing during the transmission operation of the automatic transmission, the output torque fluctuation is so large that smooth transmission operation is impaired and a great transmission shock could result. More specifically, since the engine speed or load changes at the time of transmission, the target valve timing also changes accordingly. Thus, the synergistic effect between the transmission operation and valve timing switching increases the shock at the time of transmission, and therefore there is a demand for improvement to such a state in order to provide more comfortable driving conditions.

In this case, while the above publication describes techniques of alleviating the output torque fluctuation, they are all related to alleviation in the torque fluctuation at the time of shift down, and there is no technique disclosed which is particularly directed to alleviation in a transmission fluctuation at the time of shift up. More specifically, at the time of shift up by the automatic transmission, a change in the advance angle value by the variable valve timing mechanism could cause an abrupt torque fluctuation as a lock up clutch is engaged and the transmission shock could be great.

SUMMARY OF THE INVENTION

The present invention is directed to a solution to the above-described problem, and it is an object of the present invention to provide a control device for a variable valve timing mechanism of an engine which can prevent a shock caused by an abrupt torque fluctuation during transmission operation or the switching of a lock up clutch in the engine.

In order to achieve the above-described object, a control device for a variable valve timing mechanism of an engine installed in a vehicle having an automatic transmission according to a first aspect of the present invention includes valve timing control means for controlling an operation of the variable valve timing mechanism based on an engine operation state, and stopping the operation of the variable valve timing mechanism when the automatic transmission is in the process of transmission operation.

According to a second aspect of the present invention, in the first aspect of the invention, a torque converter having a lock up clutch capable of mechanically connecting an input side and an output side of the automatic transmission is provided between the engine and the automatic transmission, and the valve timing control means stops the operation of the variable valve timing mechanism in at least one of a case when the automatic transmission is in the process of transmission operation and a case when the lock up clutch is in the process of switching.

According to a third aspect of the present invention, in the second aspect of the invention, there is further provided transmission control means for controlling the automatic transmission and the lock up clutch based on the operation state of the engine and the vehicle, and the valve timing control means is provided with data fed from the transmission control means and stops the operation of the variable valve timing mechanism for a predetermined time period after transmission control data or lock up clutch control data is switched.

According to a fourth aspect of the present invention, in the first to third aspects, the valve timing control means prohibits a target valve timing set based on the engine operation state from being updated, and stops the operation of the variable valve timing mechanism.

More specifically, according to the first aspect of the present invention, during the transmission operation of the automatic transmission, the operation of the variable valve timing mechanism is stopped. Thus, the valve timing can be prevented from being changed because of a temporary fluctuation in the engine speed and in the engine load in association with the transmission operation, and an engine output fluctuation caused by an unnecessary fluctuation in the valve timing can be prevented, so that the torque shock can be restrained and the controllability improves.

The second aspect of the present invention is adapted to the case where a torque converter having a lock up clutch capable of mechanically connecting an input side and an output side of the automatic transmission is provided between the engine and the automatic transmission, and herein the operation of the variable valve timing mechanism is stopped when the automatic transmission is in the process of transmission operation or when the lock up clutch is in the process of switching. Thus, without mentioning the period during the transmission operation of the automatic transmission, the valve timing can be prevented from being changed in association with a temporary fluctuation in the engine speed and the engine load caused by the switching of the lock up clutch. As a result, the engine output fluctuation in association with an unnecessary change in the valve timing can be prevented and the torque shock can be restrained.

According to the third aspect of the present invention, data from the transmission control means controlling the automatic transmission and the lock up clutch based on the operation state of the engine and the vehicle is input and the operation of the variable valve timing mechanism is stopped for a predetermined time period after transmission control data or lock up clutch control data is switched. Thus, a response delay by a clutch or a brake in the automatic transmission or a response delay by the lock up clutch switching is compensated and the torque shock is more surely restrained to improve the controllability.

Furthermore, according to the fourth aspect of the present invention, the operation of the variable valve timing mechanism is stopped by preventing the target valve timing set based on the engine operation state from being updated, and holding the target valve timing at the time. Therefore, this control can be very readily incorporated in the conventional control.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

First Embodiment

Figure 1:
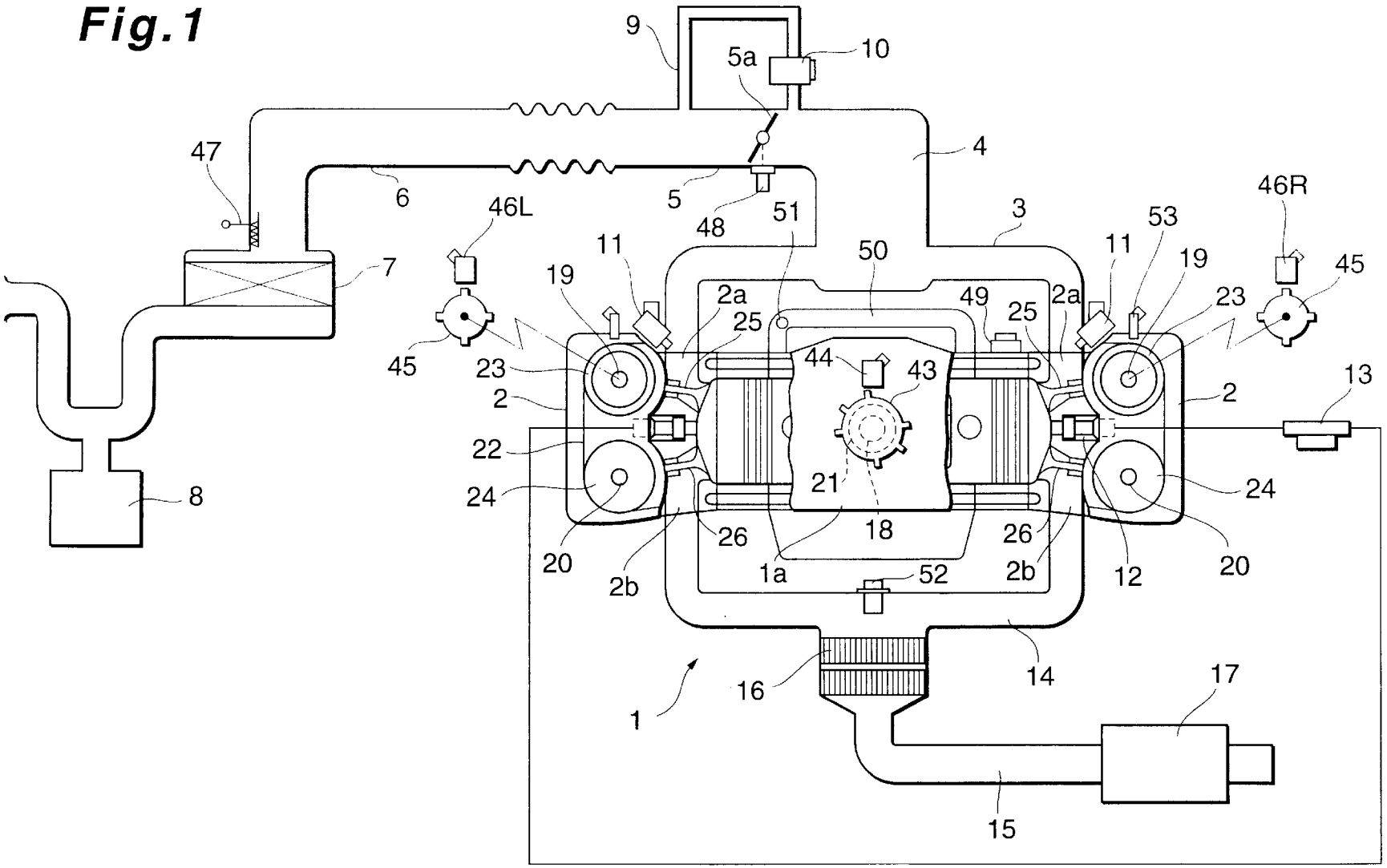
FIG. 1 is a view showing a general structure of an engine with a variable valve timing mechanism according to a first embodiment of the present invention.

An embodiment of the present invention will be now described in detail in conjunction with the accompanying drawings. The general structure of an engine with a variable valve timing mechanism to which the present invention is applied will be described first with reference to FIG. 1. In FIG. 1, reference numeral 1 represents an engine with a variable valve timing mechanism (hereinafter simply called as the "engine") installed in a vehicle having an automatic transmission such as an automobile. In FIG. 1, a DOHC (double overhead camshaft) horizontally opposed type, 4-cylinder gasoline engine is labeled 1. On the right and left banks of the cylinder block 1*a* of the engine 1, cylinder heads 2 are provided, respectively, and each cylinder head 2 has an intake port 2*a* and an exhaust port 2*b* for each cylinder.

For an intake system for the engine 1, an intake manifold 3 is in communication with each intake port 2*a*, while a throttle chamber 5 having a throttle valve 5*a* interlocked with an axle pedal inserted is in communication with the intake manifold 3 through an air chamber 4 where the intake passages of the cylinders are gathered. An air cleaner 7 is attached upstream of the throttle chamber 5 through an intake tube 6, and a chamber 8 is in communication with an air intake passage connected to the air cleaner 7.

The intake tube 6 described above is connected with a bypass passage 9 to bypass the throttle valve 5*a*, and the bypass passage 9 has an idle speed control valve (ISC valve) 10 inserted which controls the idle speed by controlling the bypass air quantity passed through the bypass passage 9 based on the valve opening at the time of idling.

Furthermore, an injector 11 is provided immediately upstream of the intake port 2*a* of each cylinder at the intake manifold 3. An ignition plug 12 having its tip discharge electrode exposed in the combustion chamber is provided for each cylinder at the cylinder head 2. The ignition plugs 12 are each connected to an igniter built-in ignition coil 13.

Meanwhile, for an exhaust system for the engine 1, an exhaust tube 15 is in communication with the gathering part of exhaust manifold 14 in communication with the exhaust ports 2*b* in the cylinder heads 2. The exhaust tube 15 has a catalytic converter 16 inserted and is in communication with a muffler 17.

With reference to FIGS. 1 to 7, the variable valve timing mechanism for the engine 1 will be now described. The rotation of the crankshaft 18 of the engine 1 is transmitted by transmission means to intake camshafts 19 and exhaust camshafts 20 provided in cylinder heads 2 on the left and right banks, respectively. According to the embodiment, the transmission means is composed of a crank pulley 21 rigidly secured to the crankshaft 18, a timing belt 22, intake cam pulleys 23, and exhaust cam pulleys 24 rigidly secured to the exhaust camshaft 20. The transfer constant is set so that the crankshaft 18 and the camshafts 19, 20 form rotating angles in the ratio of 2:1 through these belt and pulleys. A cam 19*a* provided at the intake camshaft 19 and an exhaust cam (not shown) provided at the exhaust camshaft 20 drive the intake valve 25 and the exhaust valve 26 to open/close respectively based on the rotation of the camshafts 19, 20 maintained at the rotation angles in the ratio of 2:1 with respect to the crankshaft 18.

Figure 2:
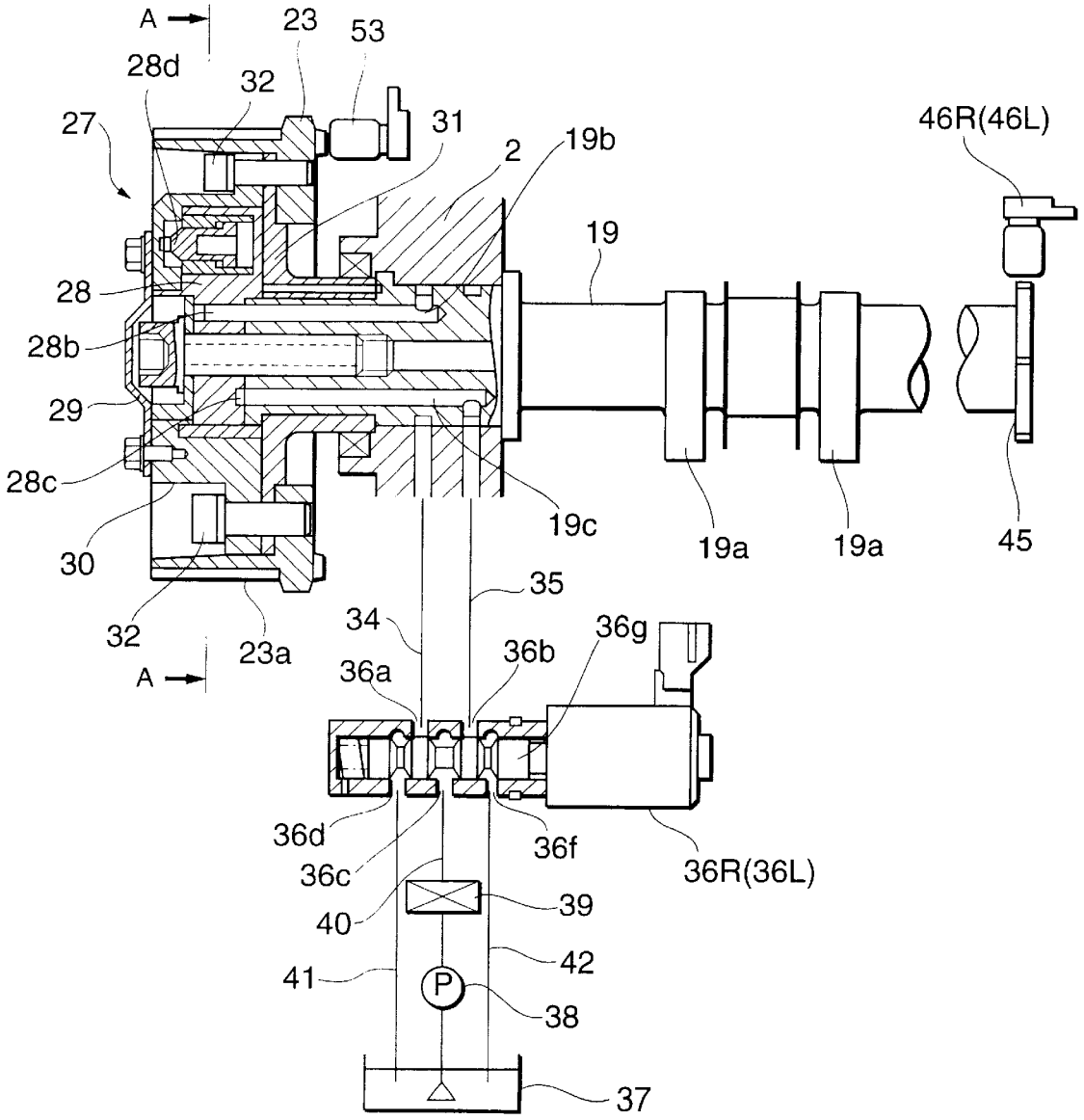
FIG. 2 is a schematic view of the variable valve timing mechanism according to the first embodiment.

Furthermore, as shown in FIG. 2, a hydraulically driven, variable valve timing mechanism (hereinafter simply called as "VVT") 27 is provided between the intake camshaft 19 and the intake cam pulley 23 each on the left and right banks. The VVT 27 relatively pivots the intake cam pulley 23 and the intake camshaft 19 and serially changes the rotation phase (displacement angle) of the intake camshaft 19 with respect to the crankshaft 18.

As well known, the VVT 27 has its hydraulic pressure switched and thus driven by an oil flow control valve (hereinafter abbreviated as "OCV") 36R (36L) operating in response to a driving signal from an electronic control unit (hereinafter abbreviated as "ECU") 60 for engine control which will be described later. Note that in the following description, subscripts L and LH represent the right bank and R and RH represent the left bank.

Figure 3:
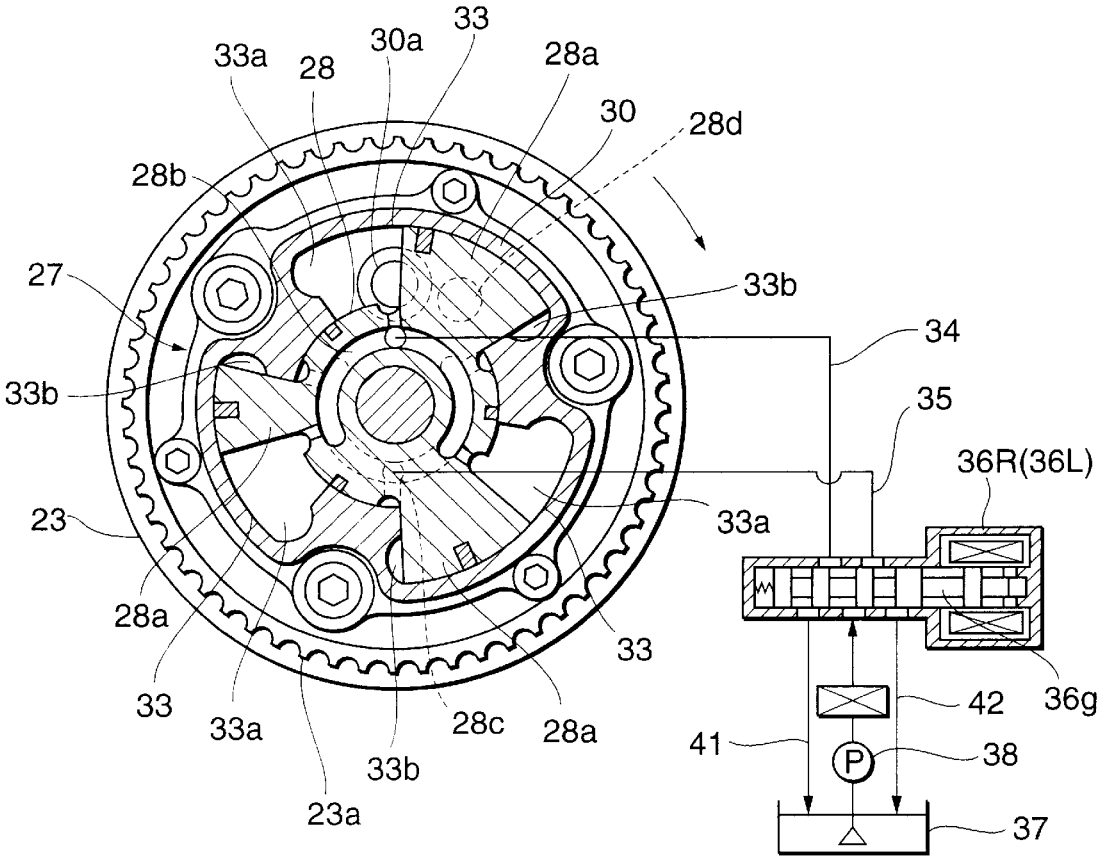
FIG. 3 is a sectional view taken along line A—A in FIG. 2 showing the most advanced angle state of the variable valve timing mechanism according to the first embodiment.
Figure 4:
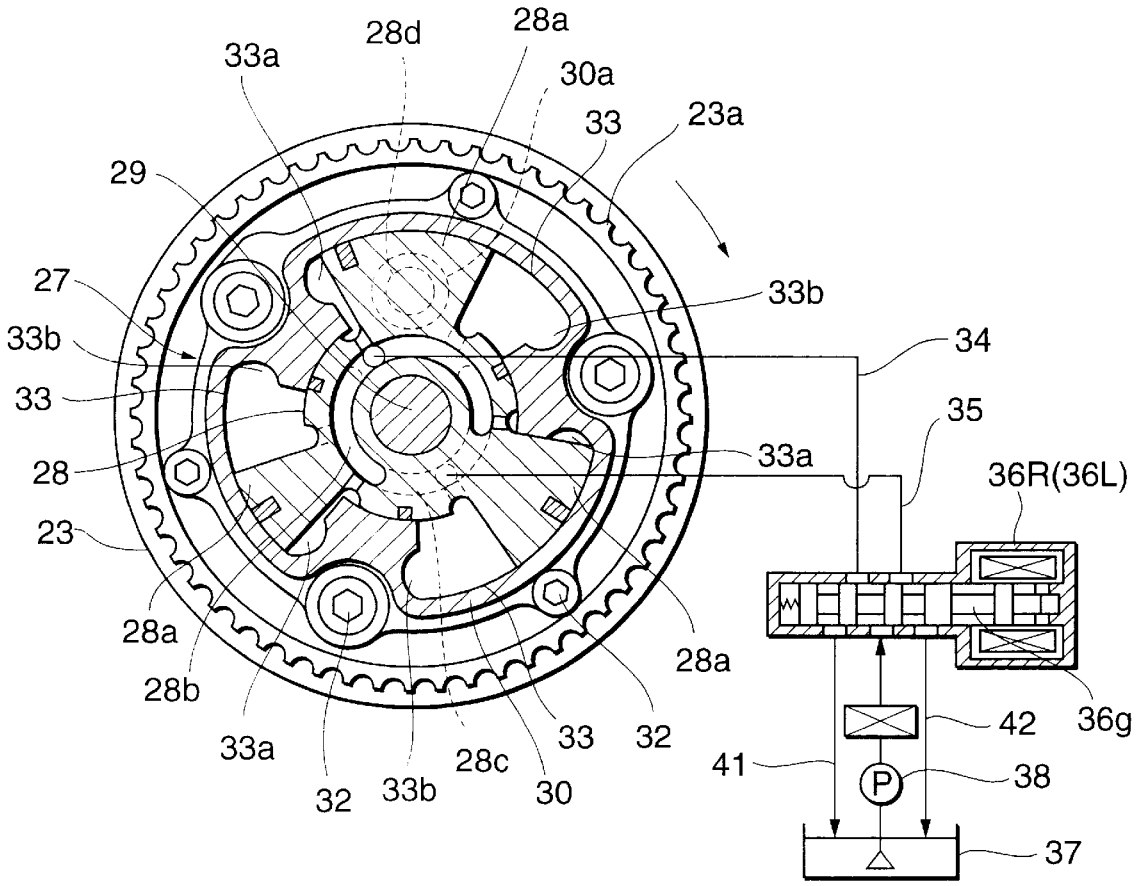
FIG. 4 is a sectional view taken along line A—A in FIG. 2 showing the most delayed angle state of the variable valve timing mechanism according to the first embodiment.

The intake camshaft 19 is rotatably supported between the cylinder head 2 and a bearing cap (not shown). As shown in FIGS. 2 to 4, a vane rotor 28 having three vanes 28*a* is integrally and rotatably provided at the tip end of the intake camshaft 19 with a bolt 29.

A housing 30 and a housing cover 31 are integrally and rotatably provided to the intake cam pulley 23 with bolts 32. At the outer circumference of the intake cam pulley 23, a number of external teeth 23*a* to hang the timing belt 22 are formed.

The intake camshaft 19 rotatably penetrates the housing cover 31, and the vanes 28*a* of the vane rotor 28 rigidly secured to the intake camshaft 19 are rotatably stored into three sector shaped spaces 33 formed in the housing 30 integrally provided with the intake cam pulley 23. The sector shaped spaces 33 are each divided into an advance angle chamber 33*a* and a delay angle chamber 33*b* by the vanes 28*a*.

The advance angle chamber 33*a* is in communication with the A port 36*a* of the OCV 36R (36L) through advance angle side oil passages 28*b*, 19*b* and 34 formed at the vane rotor 28, the intake camshaft 19, and the cylinder head 2, respectively. Meanwhile, the delay angle chamber 33*b* is in communication with the B port 36*b* of the OCV 36R (36L) through delay angle side oil passages 28*c*, 19*c* and 35 formed at the vane rotor 28, the intake camshaft 19 and the cylinder head 2, respectively.

The OCV 36R (36L) has an oil supply port 36*c* connected with an oil supply passage 40 supplied with oil, in other words provided with a predetermined hydraulic pressure through an oil pump 38 and an oil filter 39 from an oil pan 37, and drain ports 36*d* and 36*f* in communication with two drain passages 41 and 42, respectively. A spool 36*g* having four lands and three passages formed between the lands is axially reciprocated to selectively bring the A port 36*a*, the B port 36*b* into communication with the oil supply port 36*c*, the drain port 36*d* or 36*f*.

More specifically, the OCV 36R (36L) includes a linear solenoid valve or a duty solenoid valve, and serves as a four-way control valve switching the oil flow direction by allowing the spool 36*g* to reciprocate in the axial direction thereof. The OCV 36R (36L) is current-controlled or duty-controlled by an ECU 60 which will be described later, so that the valve opening is adjusted to control the level of the hydraulic pressure provided upon the advance angle chamber 33*a* and the delay angle chamber 33*b*.

Note that reference numeral 28*d* represents a stopper pin which is pressed through the vane 28*a* of the vane rotor 28 and engages with a hole 30*a* formed in the housing 30 for positioning when the VVT is in the most delayed angle state (see FIG. 4).

Note that FIG. 3 shows the most advanced angle state of the VVT 27, while FIG. 4 shows the most delayed angle state of the VVT 27.

The operation of the VVT 27 will be now described. As will be detailed later, the crank rotor 43 axially provided to the crankshaft 18 and rotating in synchronization with the crankshaft 18 is provided with a crank angle sensor 44 and a cam position sensor 46R (46L). The crank angle sensor 44 serves as a first rotation position detection sensor to detect a crank angle index by projections 43*a*, 43*b* and 43*c* (see FIG. 8) formed for each predetermined crank angle and output a crank pulse representing the crank angle. The cam position sensor 46R (46L) serves as a second rotation position detection sensor to detect a cam position index by a plurality of projections 45*a* (see FIG. 10) formed at equal angle at a cam rotor 45 rigidly secured to the rear end of the intake camshaft 19 and rotating in synchronization with the intake camshaft 19 and output a cam position pulse representing the cam position. The crank pulse output from the crank angle sensor 44 and the cam position pulse output from the cam position sensor 46R (46L) are input to the ECU 60, which performs feedback control to the VVT 27 so that the rotation phase of the intake cam position with respect to a reference crank angle based on the crank pulse and the cam position pulse, in other words, the rotation phase of the intake camshaft 19 relative to the crankshaft 18 converges to the target value (target valve timing) for the rotation phase set based on the engine operation state.

Figure 5:
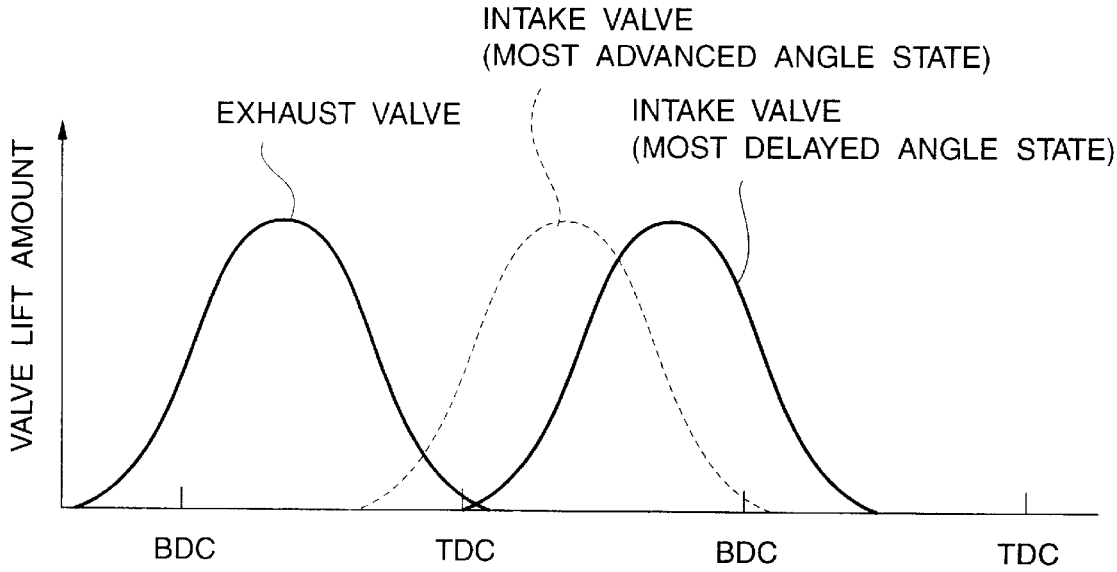
FIG. 5 is a graph for use in illustration of change in the valve timing of the intake valve to the exhaust valve according to the first embodiment.

According to the embodiment, the VVT 27 is provided only on the side of the intake camshaft 19, and as shown in FIG. 5, the timing to open/close the intake valve 25 is changed relative to the timing to open/close the exhaust valve 26.

Figure 6:
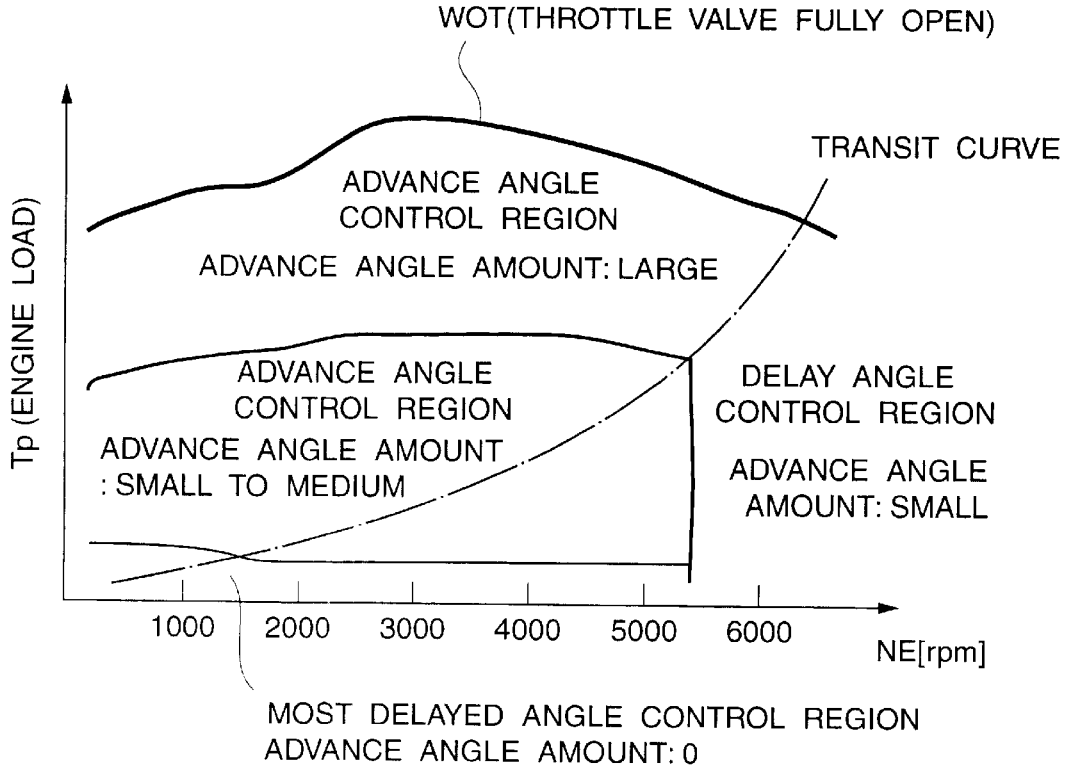
FIG. 6 is a graph for use in illustration of the valve timing characteristic according to the first embodiment.

For example as shown in FIG. 6, as values representing the engine operation state, an engine speed NE, and a basic fuel injection pulse width Tp representing the engine load (=K×Q/NE where Q represents the quantity of intake air, K an injector characteristic correction constant) are employed. During idling with a low load at a low revolution number, the timing to open/close the intake valve 25 is angularly delayed to reduce the overlap of the exhaust valve 26 and the intake valve 25, so that the idle rotation may be stabilized. During driving with a high load, the timing to open/close the intake valve 25 is angularly advanced to increase the overlap of the exhaust valve 26 and the intake valve 25, so that the scavenging efficiency may be improved to improve the engine output. During driving with a low or medium load excluding a low rotation state such as idling, the optimum valve timing for improving the fuel consumption is provided.

According to the embodiment, when the OCV 36R (36L) of a linear solenoid valve is employed, the spool 36*g* is moved to the left (angularly advanced) as shown in FIG. 3 as a function of increase in a current value output from the ECU 60 to the OCV 36R (36L). Meanwhile, the spool 36*g* is moved to the right (angularly delayed) as shown in FIG. 4 as a function of decrease in the current value. In the OCV 36R (36L), the driving current (control current value) is controlled in the range from 100 mA to 1000 mA to change the stroke of the spool 36*g*. Thus, the amount of connection between the advance angle side oil passage 34 or the delay angle side oil passage 35 and the oil supply passage 40, or between the advance angle side oil passage 34 or the delay angle side oil passage 35 and the drain ports 36*d*, 36*f* is changed in the range from 0% to 100%. Thus, the moving speed of the vane rotor 28 rigidly secured to the intake camshaft 19 to the most advanced angle side or the most delayed angle side is changed.

More specifically, if with respect to the target valve timing (the rotation phase target value) set based on the engine operation state, the rotation phase of the intake cam position relative to the reference crank angle based on the crank pulse output from the crank angle sensor 44 and the cam position pulse output from the cam position sensor 46R (46L), in other words the rotation phase (displacement angle) of the intake camshaft 19 relative to the crankshaft 18 is advanced, the ECU 60 reduces the value of the current output to the OCV 36R (36L), and the rotation phase (displacement angle) of the intake camshaft 19 relative to the crankshaft 18 is delayed by the operation of the VVT 27.

If the amount of current is reduced here, the spool 36*g* of the OCV 36R (36L) is moved to the right in the figure, and the A port 36*a* and the drain port 36*d* come into communication, so that the advance angle chamber 33*a* of the WT 27 comes into communication with the drain passage 41 through the advance angle side oil passages 28*b*, 19*b*, 34 and OCV 36R (36L). At the same time, the B port 36*b* and the oil supply port 36*c* come into communication, so that the delay angle chamber 33*b* of the VVT 27 comes into communication with the oil supply passage 40 through the delay angle side oil passages 28*c*, 19*c*, 35, and OCV 36R (36L).

Thus, the hydraulic pressure acting upon the advance angle chamber 33*a* decreases because oil is drained from the advance angle chamber 33*a* in the VVT, while the hydraulic pressure acting upon the delay angle chamber 33*b* increases with oil supplied thereto. Therefore, as shown in FIG. 4, the vane rotor 28 pivots in the anti-clockwise direction in the figure, so that the rotation phase of the intake camshaft 19 relative to the intake cam pulley 23, in other words the rotation phase (displacement angle) of the intake camshaft 19 relative to the crankshaft 18 is angularly delayed. As a result, the timing to open/close the intake valve 25 driven by the intake cam 19*a* of the intake camshaft 19 is angularly delayed.

Conversely, if with respect to the target valve timing, the rotation phase of the intake cam position relative to the reference crank angle, in other words the rotation phase (displacement angle) of the intake camshaft 19 relative to the crankshaft 18 is angularly delayed, the ECU 60 increases the current output to the OCV 36R (36L) and angularly advances the rotation phase (displacement angle) of the intake camshaft 19 relative to the crankshaft 18 by the operation of the WT 27.

More specifically, if the current value increases, the spool 36*g* of the OCV 36R (36L) is moved to the left in the figure to cause the A port 36*a* and the oil supply port 36*c* to come into communication. As a result, the advance angle chamber 33*a* in the WT 27 comes into communication with the oil supply passage 40 through the advance angle side oil passages 28*b*, 19*b*, 34 and the OCV 36R (36L). At the same time, the B port 36*b* and the drain port 36*f* come into communication with each other, so that the delay angle chamber 33*b* in the VVT 27 comes into communication with the drain passage 42 through the delay angle side oil passages 28*c*, 19*c*, 35 and OCV 36R (36L).

As a result, oil is supplied to the advance angle chamber 33*a* in the VVT to cause the hydraulic pressure acting upon the advance angle chamber 33*a* to increase, while oil drains from the delay angle chamber 33*b* to cause the hydraulic pressure acting upon the delay angle chamber 33*b* to decrease. Therefore, as shown in FIG. 3, the vane rotor 28 pivots in the clockwise direction in the figure, and the rotation phase of the intake camshaft 19 relative to the intake cam pulley 23, in other words the rotation phase (displacement angle) of the intake camshaft 19 relative to the crankshaft 18 is angularly advanced. As a result, the timing to open/close the intake valve 25 driven by the intake cam 19*a* of the intake camshaft 19 is angularly advanced.

Therefore, the VVT 27 is subjected to feedback control so that the rotation phase (displacement angle) of the intake camshaft 19 relative to the crankshaft 18 converges to the target valve timing, i.e., the rotation phase target value (target displacement angle) set based on the engine operation state.

Figure 7A:
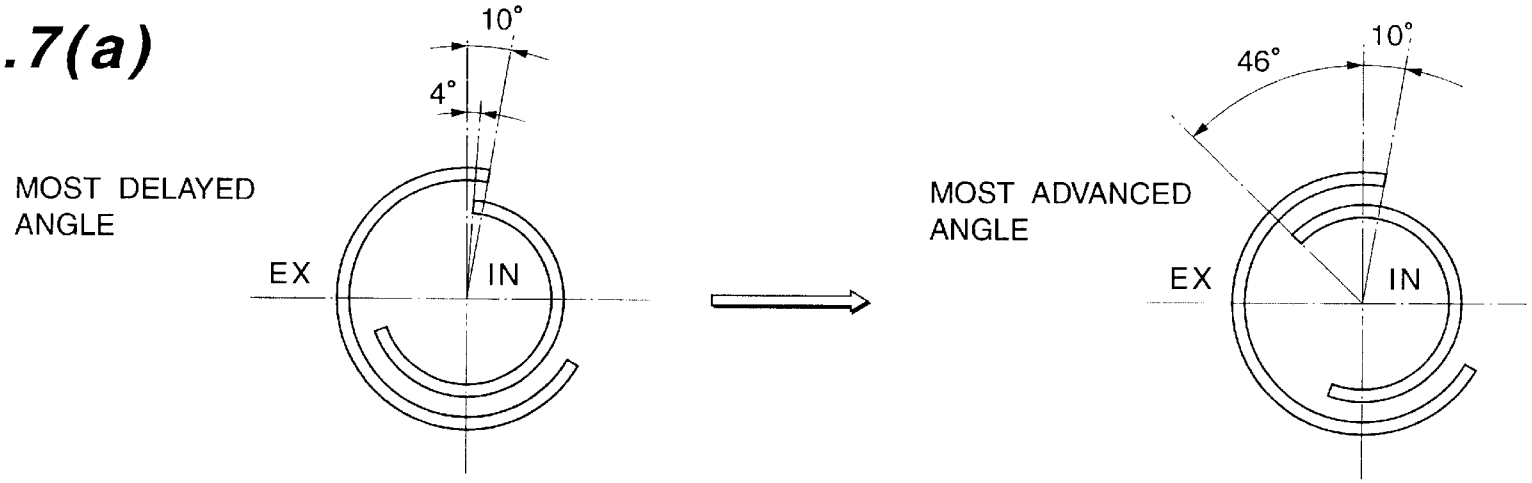
FIGS. 7(*a*) and 7(*b*) are diagrams for use in illustration of change in the valve overlap amount of the intake valve and the exhaust valve by the variable valve timing mechanism according to the first embodiment.
Figure 7B:
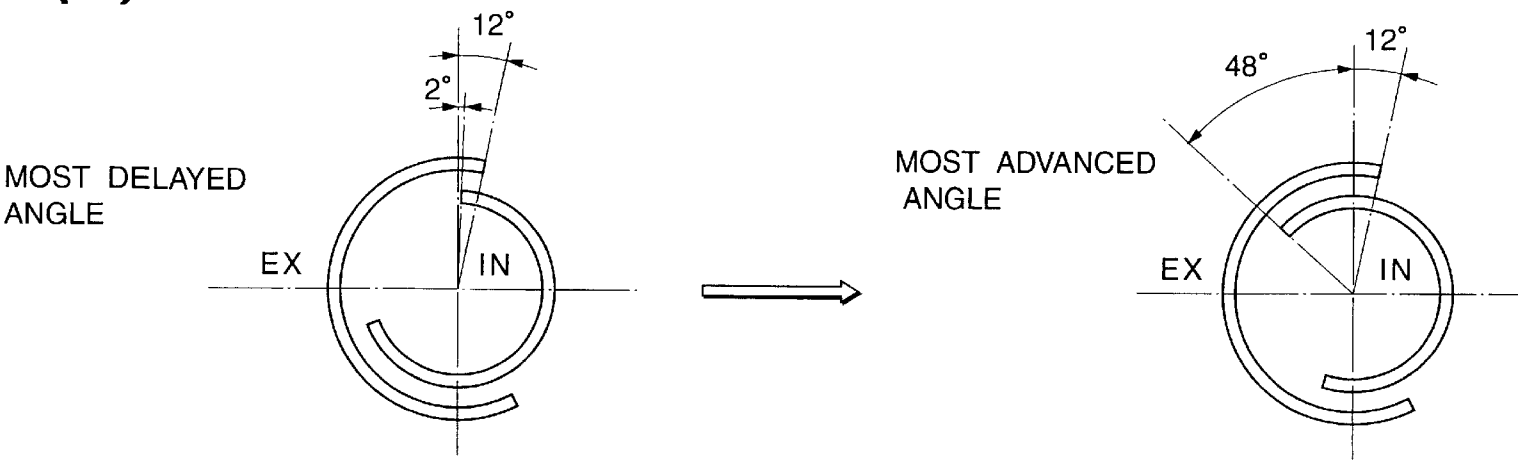

Note that according to the embodiment, as shown in FIG. 7(*a*), in the intake valve 25 and the exhaust valve 26 on the front side among the intake valves 25 and the exhaust valves 26 of the cylinders, the valve overlap amount in the most delayed angle state of the intake valve 25 relative to the exhaust valve 26 is set to 6° CA (crank angle), and the valve overlap amount in the most advanced angle state is set to 56° CA. As shown in FIG. 7(*b*), in the intake valve 25 and the exhaust valve 26 on the rear side among the intake valves 25 and the exhaust valves 26 of the cylinders, the valve overlap amount in the most delayed angle state of the intake valve 25 relative to the exhaust valve 26 is set to 10° CA, while the valve overlap amount in the most advanced angle state is set to 60° CA.

Therefore, according to the embodiment, the rotation phase of each intake camshaft 19 relative to the crankshaft 18 (the intake cam pulley 23) is changed by at most 50° CA by the VVT 27.

Sensors for detecting the engine operation state will be now described.

A thermal intake air quantity sensor 47 using a hot wire, a hot film, or the like is provided immediately downstream of the air cleaner 7 in the intake tube 6 and a throttle valve opening sensor 48 is provided with and connected to the throttle valve 5*a* provided at the throttle chamber 5.

A knock sensor 49 is attached to the cylinder block 1*a* in the engine 1, and a cooling water temperature sensor 51 serving as temperature detection means for detecting the temperature of the engine 1 is provided facing a cooling water passage 50 communicating both the left and right banks of the cylinder block 1*a*. An $O_2$ sensor 52 is provided upstream of the catalytic converter 16.

The crank angle sensor 44 is provided opposing the outer circumference of the crank rotor 43 axially attached to the crankshaft 18 of the engine 1. A cylinder determination sensor 53 is provided opposing the rear surface of the intake cam pulley 23 rotating at the ratio of ½ relative to the crankshaft 18 (see FIG. 2). The cam position sensor 46R (46L) is provided opposing the outer circumference of the cam rotor 45 rigidly secured to the rear end of the intake camshaft 19.

Figure 8:
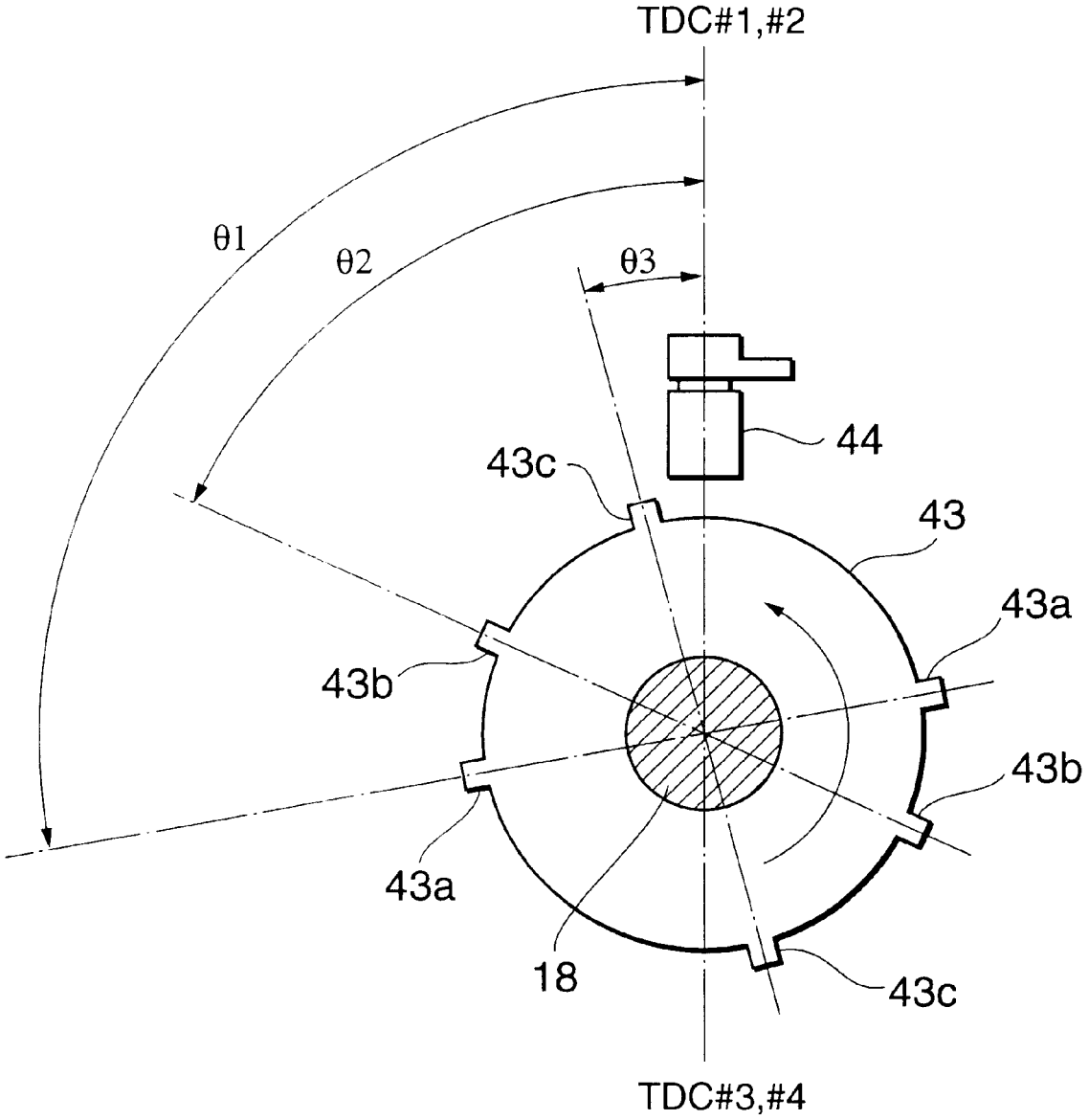
FIG. 8 is a front view of a crank rotor and a crank angle sensor according to the first embodiment.

Projections 43*a*, 43*b* and 43*c* are formed at the outer circumference of the crank rotor 43 as shown in FIG. 8, and the projections 43*a*, 43*b* and 43*c* are formed at positions at θ1, θ2 and θ3, respectively BTDC (before top dead center) in compression of each cylinder (cylinders #1, #2, cylinders #3, #4). According to the embodiment, θ1=97° CA, θ2=65° CA, and θ3=10° CA.

Figure 9:
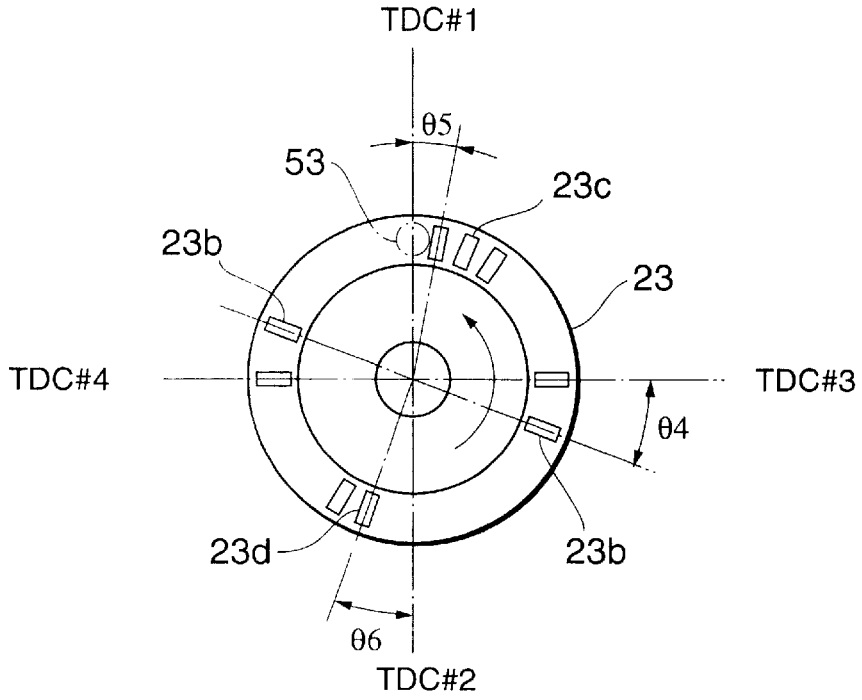
FIG. 9 is a rear view of an intake cam pulley according to the first embodiment.

As shown in FIG. 9, on the side of the outer circumference of the rear surface of the intake cam pulley 23, projections 23*b*, 23*c* and 23*d* for determining the cylinders are formed. The projection 23*b* is formed at the position of θ4 ATDC (after top dead center) in compression of cylinders #3, #4. The projection 23*c* is formed of three projections, the first one of which is formed at the position of θ5 ATDC of the cylinder #1. The projection 23*d* is formed of two projections, the first one of which is formed at the position of θ6 ATDC of the cylinder #2. Note that according to this embodiment, θ4=20° CA, θ5=5° CA, and θ6=20° CA. These projections 23*b*, 23*c* and 23*d* and the cylinder determination sensor 53 are provided only on one bank.

Figure 10:
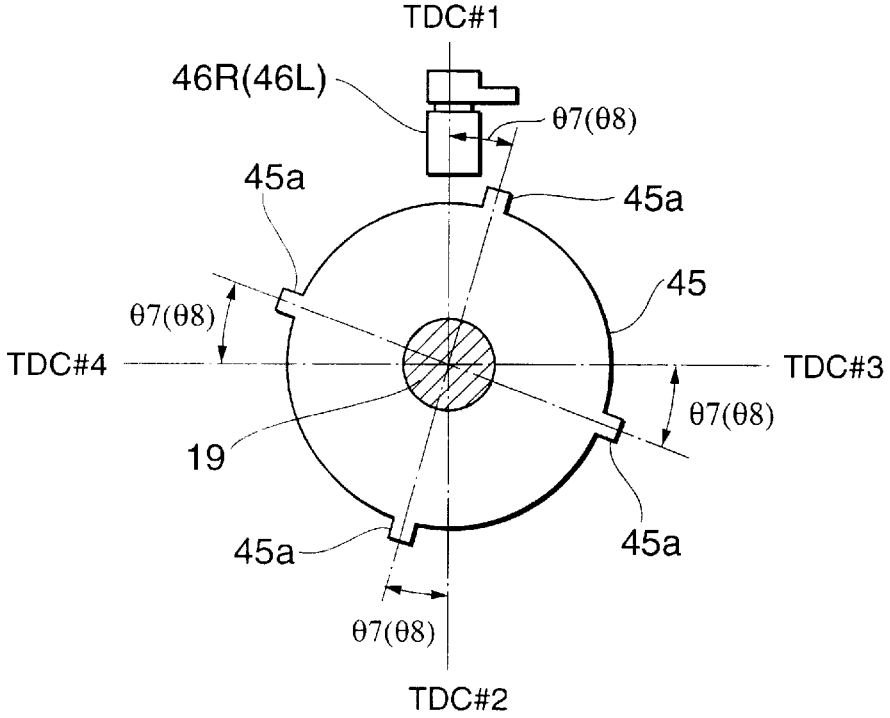
FIG. 10 is a front view of a cam rotor and a cam position sensor according to the first embodiment.

Since the 4-cylnder engine is employed for the engine 1 according to this embodiment, as shown in FIG. 10, the cam rotor 45 has four projections 45*a* for detecting the cam position at the outer circumference equally at 180° CA. The projections 45*a* each change by the operation of the VVT 27 at θ7 in the range from 40° CA BTDC to 10° CA ATDC with reference to the compression top dead center of each cylinder. FIG. 10 shows the cam rotor 45 rigidly secured to the intake camshaft 19 on the RH side, while four projections 45*a* for detecting the cam position are formed similarly equally at 180° CA at the outer circumference of the intake camshaft 19 on the LH side. These projections 45*a* each change by the operation of the VVT 27 at θ8 in the range from 40° CA BTDC to 10° ATDC with reference to the compression top dead center of each cylinder.

Figure 11:
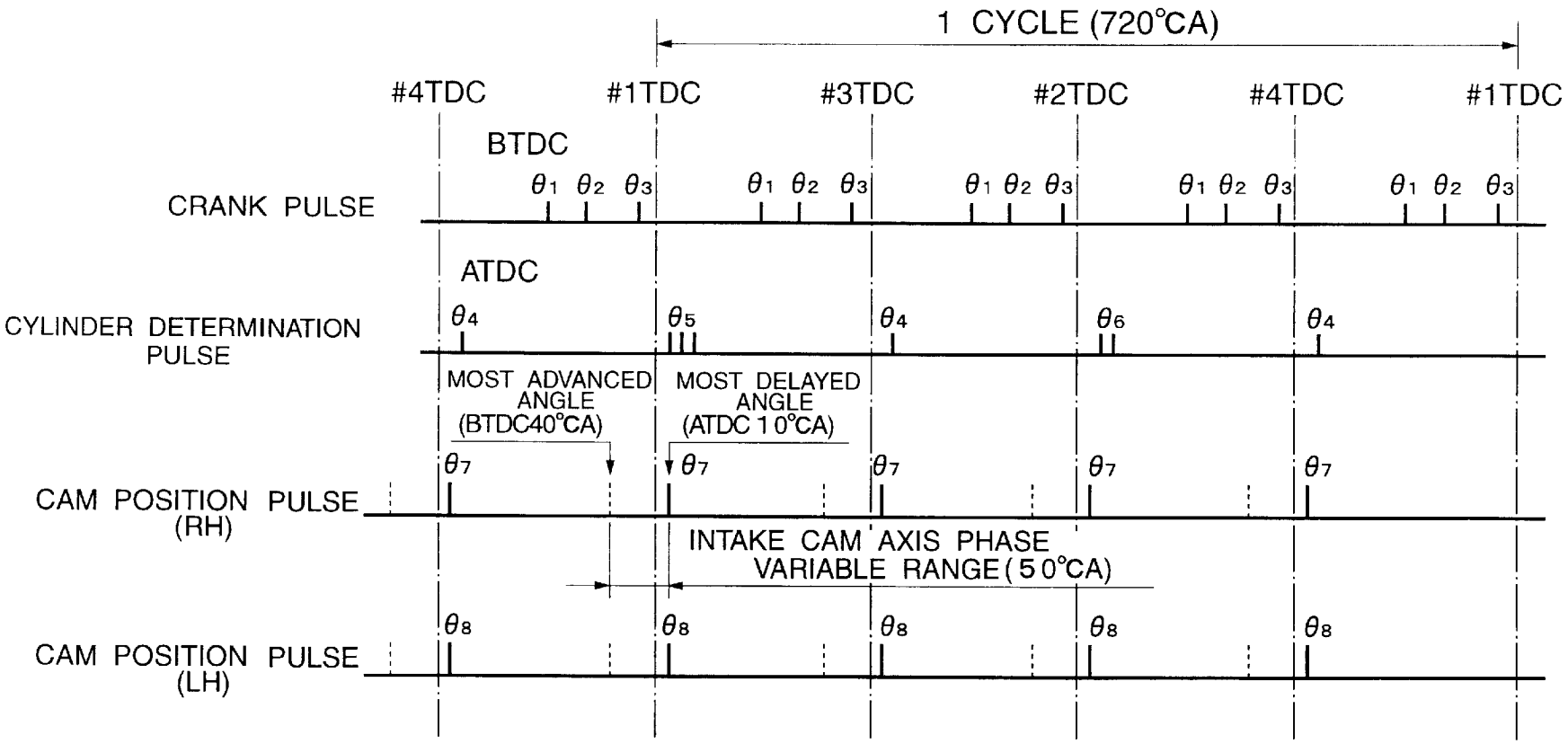
FIG. 11 is a timing chart for use in illustration of the relation between the crank pulse, the cylinder determination pulse and the cam position pulse according to the first embodiment.

As shown in the timing chart in FIG. 11, as the engine operates, the crankshaft 18, the intake cam pulley 23, and the intake camshaft 19 rotate to rotate the crank rotor 43 and the cam rotor 45, so that the projections 43*a*, 43*b* and 43*c* of the crank rotor 43 are detected by the crank angle sensor 44. Crank pulses corresponding to θ1, θ2 and θ3 (97° CA, 65° CA and 10° CA BTDC) are output from the crank angle sensor 44 for each half turn of the engine (for each 180° CA). The projections 23*b*, 23*c* and 23*d* of the intake cam pulley 23 are detected by the cylinder determination sensor 53 between the θ3 crank pulse and the θ1 crank pulse, so that a predetermined number of cylinder determination pulses are output from the cylinder determination sensor 53.

Meanwhile, the projections 45*a* of the cam rotor 45 rigidly secured to the rear end of the intake camshaft 19 each at the right and left banks whose rotation phase changes relative to the crankshaft 18 by the VVT 27 are detected by the cam position sensors 46R, 46L, and the cam position pulses at θ7 and θ8 are output from the cam position sensors 46R and 46L, respectively.

In the following ECU 60 for engine control, the engine speed NE is calculated based on the input interval time of the crank pulse output from the crank angle sensor 44. Meanwhile, based on patterns of orders of combustion steps for the cylinders (such as the order of cylinders: #1→#3→#2→#4) and values produced by counting cylinder determination pulses from the cylinder determination sensor 53 using the counter, a cylinder in the process of combustion, a cylinder to be injected with fuel and a cylinder to be ignited are determined.

Furthermore, the ECU 60 calculates the rotation phase (displacement angle) of the intake cam position relative to the reference crank angle based on the crank pulse (such as the θ1 pulse) output from the crank angle sensor 44 and the cam position pulses θ7, θ8 output from the cam position sensors 46R, 46L. Here, the rotation time per unit angle can be obtained from the engine speed NE, and the time per unit angle rotation may be multiplied by time between input of the θ7, θ8 cam position pulses and input of the θ1 crank pulse to obtain the rotation phase (displacement angle) of the intake cam position relative to the reference crank angle, in other words the rotation phase (displacement angle) of each intake camshaft 19 relative to the crankshaft 18.

Figure 12:
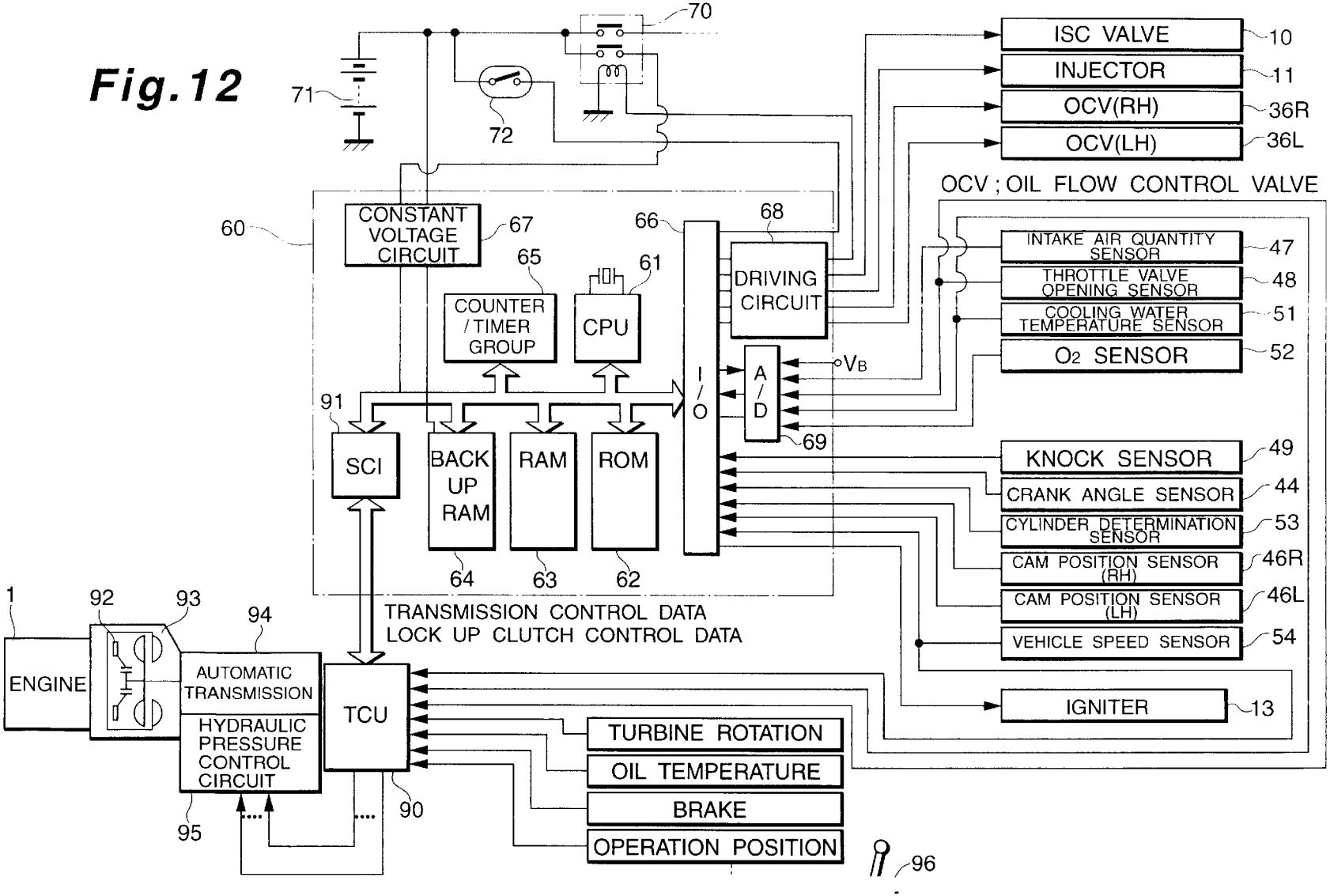
FIG. 12 is a circuit diagram of an electronic control system according to the first embodiment.

The ECU 60 described above performs operation of the control amount for actuators such as the OCVs 36R, 36L to adjust hydraulic pressure to be provided to the injector 11, the ignition plug 12, the ISC valve 10 and the VVT 27 described above, outputs control signals, in other words, the ECU performs fuel injection control, ignition timing control, idle speed control, the valve timing control relative to the intake valve 25 (VVT control) and the like. As shown in FIG. 12, the ECU essentially includes a microcomputer composed of a CPU 61, a ROM 62, a RAM 63, a backup RAM 64, a counter/timer group 65, an I/O interface 66 and a serial communication interface (SCI) 91 connected through a bus line. Peripheral circuits such as a constant voltage circuit 67 to supply stabilized power supply to each part, a driving circuit 68 connected to the I/O interface 66 and an A/D converter 69 are built-in.

Note that the above-described counter/timer group 65 generally represents for convenience sake various counters such as a free run counter and a counter for counting input of cylinder determination signals (cylinder determination pulses), various timers such as a fuel injection timer, an ignition timer, a periodical interruption timer for causing a periodical interruption, a timer for counting the input interval of a crank angle sensor signal (crank pulse) and a watchdog timer for monitoring for system abnormality Various other software counters/timers are also used.

The above-described constant voltage circuit 67 is connected to a battery 71 through a first relay contact of a power supply relay 70 having two circuit relay contacts, and the power supply relay 70 has one end of the relay coil grounded, and the other end connected to the driving circuit 68. Note that the second relay contact of the power supply relay 70 is connected with a power supply line to supply power to each actuator from the battery 71. The battery 71 is connected with one end of an ignition switch 72, the other end of which is connected to an input port of the I/O interface 66.

The above-described constant voltage circuit 67 is also directly connected with the battery 71, and supplies power to each part in the ECU 60 when the ON state of the ignition switch 72 is detected and a contact of the power supply relay 70 is closed. Meanwhile, regardless of the ON/OFF state of the ignition switch 72, the circuit constantly provides power supply for backup to the backup RAM 64.

The input port of the I/O interface 66 described above is connected with the knock sensor 49, the crank angle sensor 44, the cylinder determination sensor 53, the cam position sensors 46R, 46L, and the vehicle speed sensor 54 to detect the vehicle speed as a vehicle operation state. The port is further connected through the A/D converter 69 with the intake air quantity sensor 47, the throttle valve opening sensor 48, the cooling water temperature sensor 51, and the $O_2$ sensor 52, while it is provided with battery voltage VB and monitored.

Meanwhile, the output port of the above-described I/O interface 66 is connected through the driving circuit 68 with the ISC valve 10, the injector 11, the OCVs 36R, 36L and the relay coil of the power supply relay 70 as well as with the igniter of the igniter-built in ignition coil 13.

The reference numeral 90 represents an electronic control unit 90 for transmission control (TCU 90: transmission control means), and includes a microcomputer as a main part similarly to the ECU 60 for engine control, and connected with the ECU 60 for engine control through the SCI 91 in a manner in which data is exchangeable with one another.

According to the embodiment, as a transmission driving system provided with and connected to the output shaft of the engine 1, a torque converter 93 including a lock up clutch 92 to allow an impeller and a turbine to be engaged so that the input side and the output side are mechanically connected is provided with and connected to the automatic transmission 94. The automatic transmission 94 includes a clutch mechanism portion including various hydraulic clutches and various hydraulic brakes to switch between going-forward/backward and transmission, and a main transmission mechanism portion including planetary gears and the like. The automatic transmission 94 is provided with and connected to a hydraulic pressure control circuit 95 formed integrally with various control valves to control line pressure and pilot pressure to each of the mechanism portions.

The TCU 90 is provided with signals from the throttle valve opening sensor 48 and the cooling water temperature sensor 51 which are shared with the ECU 60, and the vehicle speed sensor 54, a turbine revolution number signal, an ATF (automatic transmission fluid) oil temperature signal, a brake signal, a signal indicating the operation position (transmission range position) of a select mechanism portion 96 and the like. Under the control of the hydraulic pressure control circuit 95, the lock up clutch 92 is engaged/slipped/disengaged, and the automatic transmission 94 is controlled for transmission.

The lock up clutch 92 is controlled for example by determining the characteristic of engagement/slip/disengagement of the lock up clutch 92 based on the throttle valve opening and the vehicle speed for each transmission range position and each running pattern and controlling the clutch operation hydraulic pressure through a control valve (not shown) provided at the hydraulic pressure control circuit 95.

The above-described ECU 60 processes detection signals from sensors/switches input through the I/O interface 66 and battery voltage at CPU 61 according to a control program stored in the ROM 62. The ECU 60 also receives transmission control data for the automatic transmission 94 and control data for the lock up clutch 92 from the TCU 90 through the SCI 91. Based on the received data, various data stored in the RAM 63, various learning value data stored in the back up RAM 64, fixed data stored in the ROM 62 or the like, the fuel injection amount, the ignition timing, the duty ratio of the control signal relative to the ISC valve 10 and a control current value for the OCVs 36R, 36L and the like are operated, and the engine is controlled as to the fuel injection, the ignition timing, the idle speed, the valve timing (VVT control) and the like.

Herein, as described above, in the valve timing control, based on the crank pulse output from the crank pulse sensor 44 and the cam position pulse output from the cam position sensor 46R (46L), the control current value to the OCVs 36R, 36L is operated so that the rotation phase of the intake cam position relative to the reference crank angle, in other words the rotation phase of the intake camshaft 19 relative to the crankshaft 18 converges to the target valve timing set based on the engine operation state. The control current value is output to the OCVs 36R, 36L to perform feedback control to the VVT 27.

Furthermore, the ECU 60 stops the operation of the VVT 27 during the transmission operation of the automatic transmission 94 or the switching operation of the lock up clutch 92 in order to prevent an engine output fluctuation during such operations and thus restrain the torque shock. More specifically, the ECU 60 reads the transmission control data and the lock up clutch control data in the TCU 90, and determines whether or not the automatic transmission 94 is in the process of transmission operation, and whether or not the lock up clutch 92 is in the process of switching based on switching of the control data. If the automatic transmission 94 is in the process of transmission operation, or the lock up clutch 92 is in the process of switching, the target valve timing VTTGT is prohibited from being changed, and the target valve timing VTTGT at the time is held to stop the operation of the VVT 27.

Herein, the operation of the VVT 27 is stopped by prohibiting the target valve timing VTTGT set based on the engine operation state from being updated, and holding the target valve timing VTTGT at the time. Therefore this control can be very readily introduced into the conventional control.

Furthermore, the ECU 60 prohibits the target valve timing VTTGT from being updated and stops the operation of the VVT 27 for a predetermined time period after the transmission control data for the automatic transmission 94 or the control data for the lock up clutch 92 is switched. Thus, a response delay by a clutch or brake in the automatic transmission 94 or a response delay by switching the lock up clutch 92 can be compensated and the torque shock can be more surely restrained so that the controllability improves.

More specifically, the ECU 60 implements the function of valve timing control means according to the present invention, while the TCU 90 implements the function of transmission control means.

Figure 13:
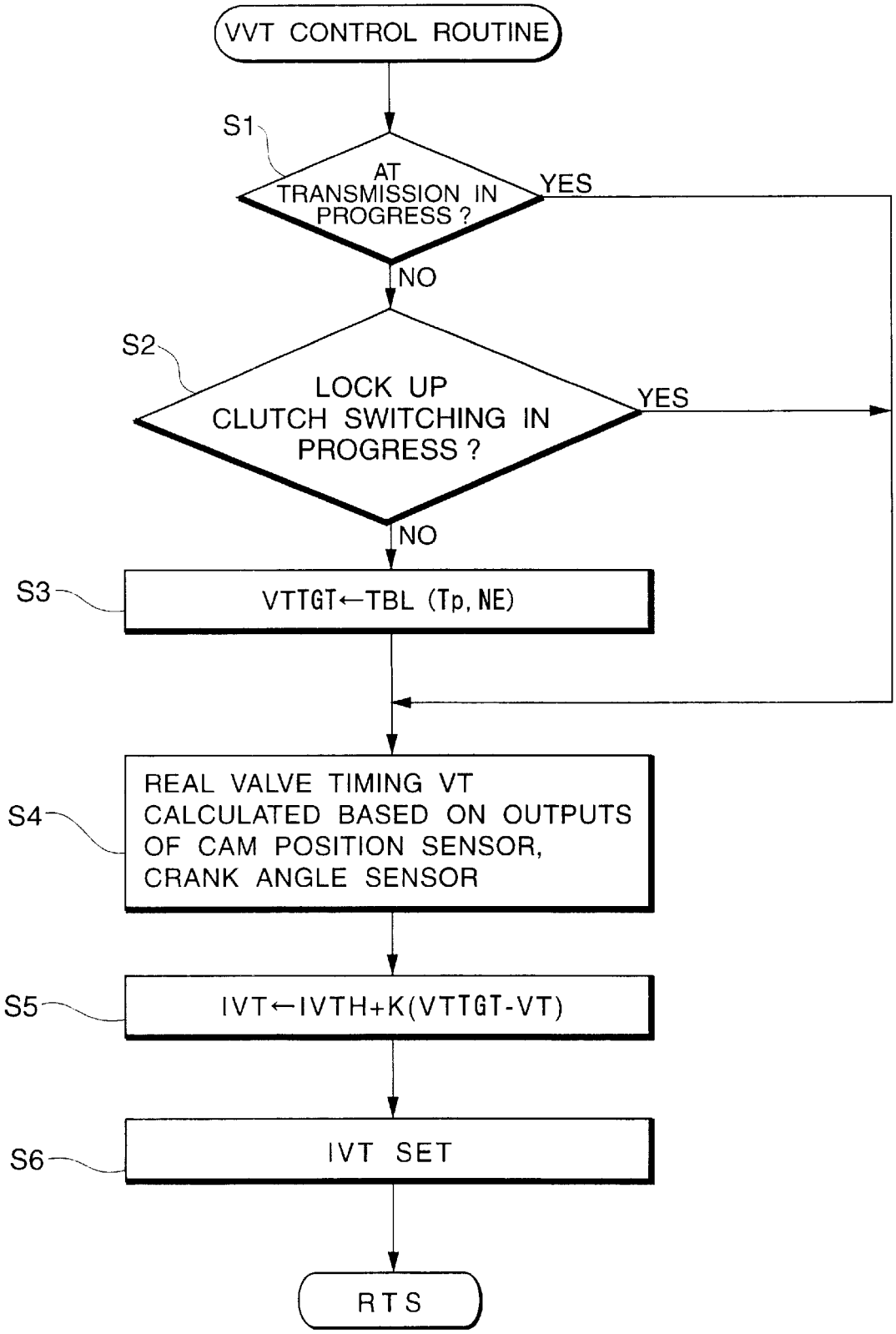
FIG. 13 is a flow chart for use in illustration of a variable valve timing control routine according to the first embodiment.

The valve timing control according to the first embodiment achieved by the ECU 60 will be now described in conjunction with the flow chart shown in FIG. 13. FIG. 13 is a flow chart for use in illustration of a valve timing control routine. In this control, the target valve timing VTTGT is prohibited from being updated during the transmission operation of the automatic transmission 94 or the switching operation of the lock up clutch 92, so that the operation of changing the valve timing during the period is stopped and an engine torque fluctuation in the transmission operation or the lock up clutch switching operation is restrained to alleviate the shock.

The ignition switch 72 is turned on, and then when the ECU 60, the TCU 90 are supplied with power, the system is initialized and the flags and counters excluding those for trouble data and data such as various learning values stored in the back up RAM 64 are initialized. When the starter switch (not shown) is turned on to activate the engine 1, the variable valve timing control routine shown in FIG. 13 is executed at the interval of a predetermined time period (such as 10 msec).

Figure 14:
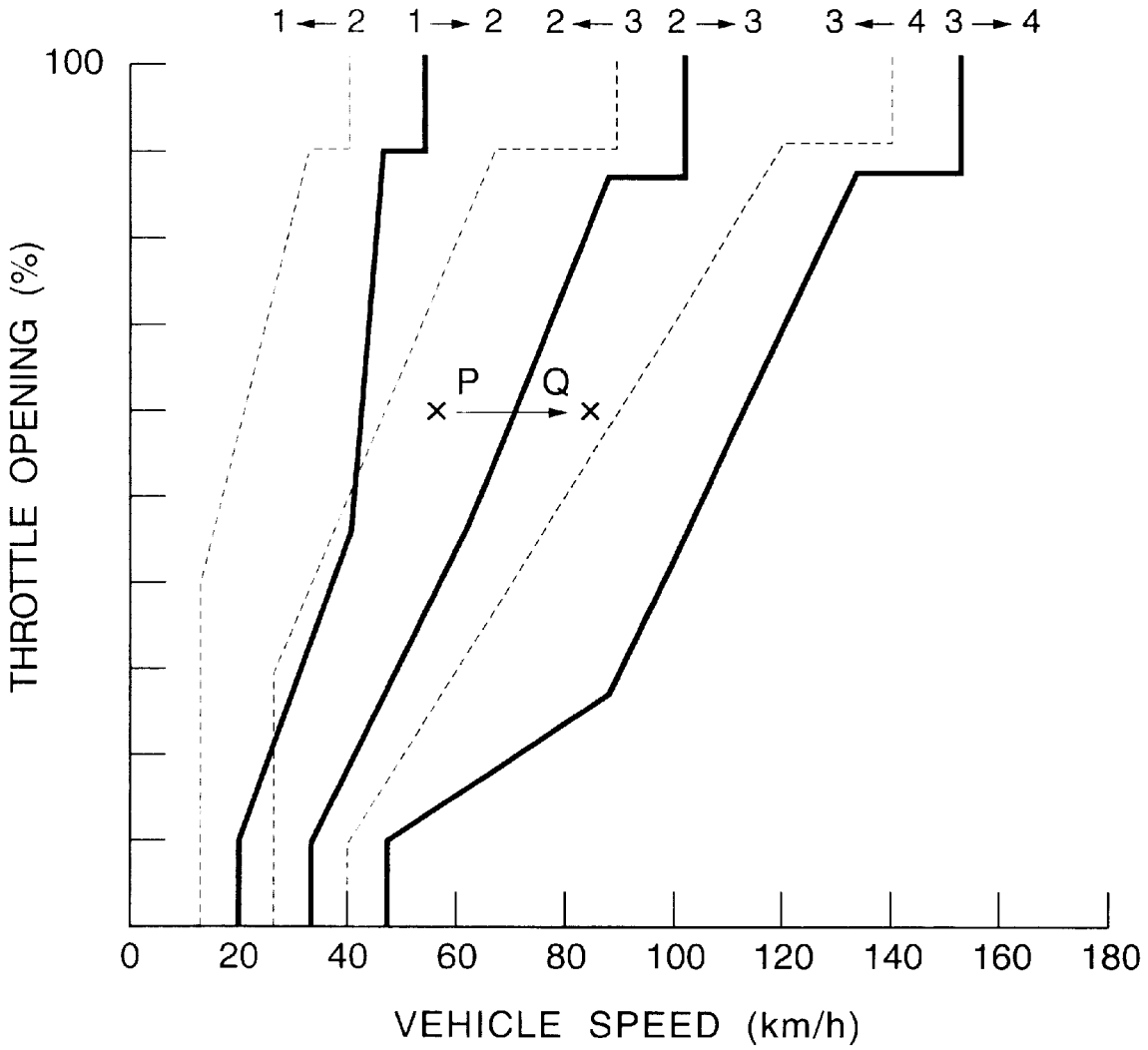
FIG. 14 is a graph for use in illustration of a control map providing a transmission pattern to the automatic transmission according to the first embodiment.

In step S1, based on transmission control data for the automatic transmission 94 read from the TCU 90 through the SCI 91, it is determined whether or not the automatic transmission (AT) 94 is in the process of transmission operation. FIG. 14 is a map to provide a transmission characteristic when the automatic transmission 94 is controlled in transmission operation, and stored in the TCU 90. The solid line represents a transmission pattern at the time of shift up (1→2; first speed to second speed), while the broken line represents a transmission pattern at the time of shift down (2→1: second speed to first speed).

If for example the vehicle speed increases, and the driving area moves from the point P to the point Q in FIG. 14, the transmission control data in the TCU 90 changes to shift the automatic transmission 94 from the second speed to the third speed. Therefore, whether or not the automatic transmission 94 is in the process of transmission operation may be determined based on change in the transmission control data in the TCU 90.

Here, if the valve timing is changed during the transmission operation of the automatic transmission 94, the torque fluctuation increases by the synergistic effect of the transmission operation and change in the valve timing, which causes a great shock in the transmission operation. Therefore, during the transmission operation of the automatic transmission 94, the target valve timing VTTGT based on the engine operation state in the following step S3 is not updated, and the control jumps to step S4.

The valve timing control employed in the embodiment is a feedback control to allow the real valve timing VT to converge to the target valve timing VTTGT set based on the engine operation state. Therefore, if the automatic transmission 94 is in the process of transmission operation, the control jumps to step S4 without updating the target valve timing VTTGT, so that the target valve timing VTTGT is substantially prohibited from being updated. Since the target valve timing VTTGT is held as is, the phase difference between the target valve timing VTTGT and the real valve timing VT is eliminated and the operation of the VVT 27 is stopped.

Figure 15:
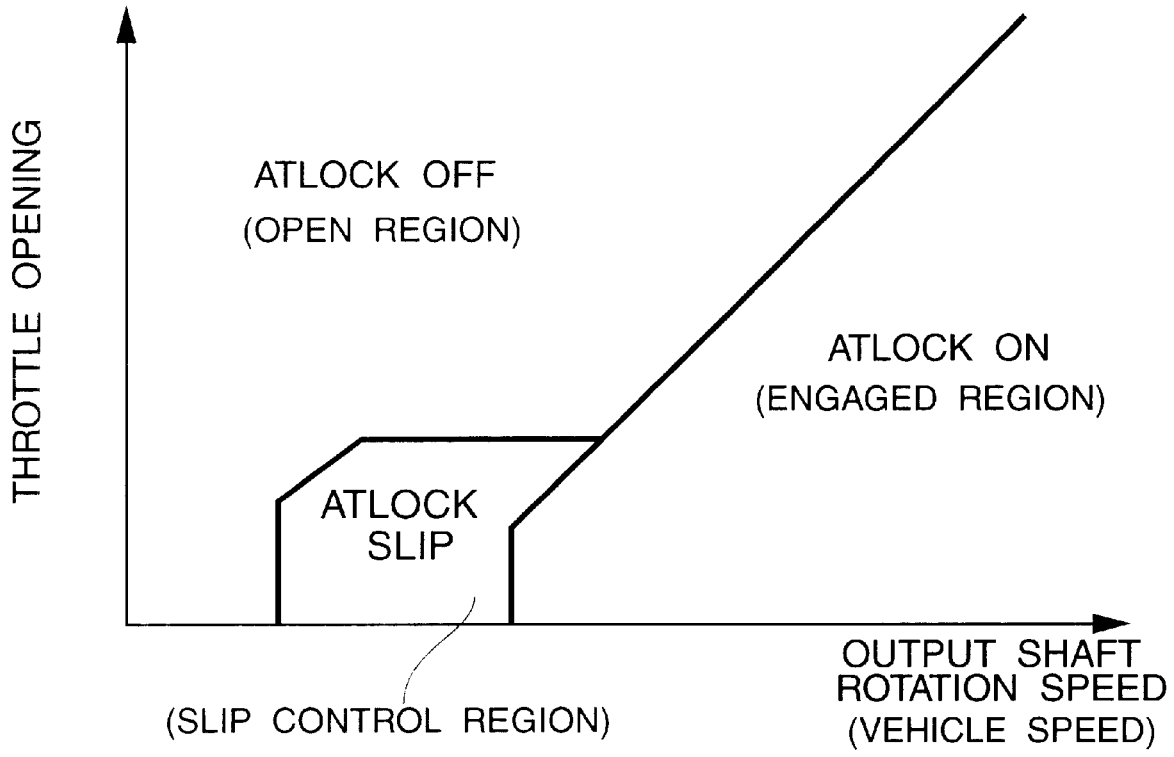
FIG. 15 is a graph for use in illustration of a lock up clutch control region map.

Meanwhile, if it is determined in step Si that the automatic transmission 94 is not in the process of transmission operation, the control proceeds to step S2, and it is determined whether or not the lock up clutch 92 is in the process of the switching operation based on the control data for the lock up clutch 92 read from the TCU 90 through the SCI 91. FIG. 15 is a control map giving the switching characteristic when the lock up clutch 92 is switched between the disengaged, slipped and engaged states, and the map is stored in the TCU 90. Therefore, whether or not the lock up clutch 92 is in the process of switching can be determined based on change in the lock up clutch control data in the TCU 90 based on the control map.

Here, if the valve timing is changed during the switching operation of the lock up clutch 92, the torque fluctuation increases by the synergistic effect of the switching operation of the lock up clutch 92 and the change in the valve timing, which increases the shock at the time of switching operation of the lock up clutch 92. Therefore, similarly to the control during the transmission operation of the automatic transmission 94, during the switching operation of the lock up clutch 92 the target valve timing VTTGT based on the engine operation state is not updated in step S3 which will be described later, in other words, the target valve timing VTTGT is substantially prohibited from being updated, and the control jumps to step S4.

Therefore, during the switching operation of the lock up clutch 92, the target valve timing VTTGT is held as is, the phase difference between the target valve timing VTTGT and the real valve timing VT is eliminated so that the operation of the VVT 27 is stopped.

Meanwhile, if it is determined in step S2 that the lock up clutch 92 is not in the process of the switching operation, the control proceeds to step S3, and based on the basic fuel injection pulse width Tp representing the engine load and the present value of engine speed NE as the engine operation state, a table previously stored in the ROM 62 (see FIG. 6) is retrieved, and a target valve timing VTTGT is set based on the present value by interpolation calculation, and the control proceeds to step S4.

In step S4, based on the outputs of the cam position sensor 46R (46L) and the crank angle sensor 44, the real valve timing VT representing the present actual valve timing is calculated. Then in the following step S5, based on the difference between the real valve timing VT and the present target valve timing VTTGT, a control current value IVT for the OCV 36R (36L) is calculated. More specifically, what is produced by multiplying the difference between the target valve timing VTTGT and the real valve timing VT (VTTGT-VT) by a proportional gain K is added to the held current value IVTH at the OCV 36R (36L) to produce the control current value IVT.

In this case, in a normal state, the target valve timing VTTGT is set based on the engine operation state at the time, and the control current value IVT is set based on the difference between the target valve timing VTTGT and the real valve timing VT. Meanwhile, during the transmission operation of the automatic transmission 94 or the switching operation of the lock up clutch 92, the target valve timing VTTGT is prohibited from being changed, and the control current value IVT is set based on the held target valve timing VTTGT. More specifically, during the transmission operation or the lock up clutch switching operation, the target valve timing VTTGT is prohibited from being changed in order to maintain the valve timing up to that point so that the operation of the VVT 27 is stopped, and the control current value IVT is set. Therefore, the engine output is prevented from fluctuating, which restrains the torque shock.

Note that the held current value IVTH is a value produced by learning as well known from Japanese Patent Laid-Open Publication No. Hei. 8-109840, and the value corresponds to a control current value at which the vane rotor 28 is displaced neither to the advance angle side nor to the delay angle side. More specifically, when the OCV 36R (36L) is controlled by a certain control current value, it is learned as the held current value IVTH a current value at which the spool 36*g* of the OCV 36R (36L) is displaced to a position to block the A port 36*a*, B port 36*b* with the land, and the connection amount between the advance angle side oil passage 34, the delay angle side oil passage 35, and the oil supply port 36*c* and between the advance angle side oil passage 34, the delay angle side oil passage 35 and each of the drain ports 36*d*, 36*f* each become 0% and the vane rotor 28 attains a moving speed of zero and held at the position.

Then in step S6, the control current value IVT is set to exit the routine. Thus, a driving signal based on the control current value IVT is output to the OCV 36R (36L) and the stroke of the spool 36*g* of the OCV 36R (36L) is changed, oil is supplied to the advance angle chamber 33*a* or the delay angle chamber 33*b* of the VVT 27, so that the valve timing is angularly advanced or delayed. More specifically, when the spool 36*g* moves to open the advance angle side oil passage 34, the hydraulic pressure acting upon the advance angle chamber 33*a* increases, while the hydraulic pressure acting upon the delay angle chamber 33*b* is lowered as oil drains from the delay angle chamber 33*b*, so that the valve timing is angularly advanced. When the spool 36*g* moves to open the delay angle side oil passage 35, the hydraulic pressure acting upon the delay angle chamber 33*b* increases while hydraulic pressure acting upon the advance angle chamber 33*a* is lowered as oil drains from the advance angle chamber 33*a*, so that the valve timing is angularly delayed.

Thus, in the variable valve timing control routine as shown in FIG. 13, in a normal state, based on the engine operation state according to the basic fuel injection pulse width Tp representing the engine load and the engine speed NE, the target valve timing VTTGT is sequentially set, and the control current value IVT for the OCV 36R (36L) is set based on the difference between the target valve timing VTTGT and the real valve timing VT. As a result, the real valve timing VT is feedback controlled so as to converge to the target valve timing VTTGT adapted to the engine operation state. Meanwhile, during the transmission operation of the automatic transmission 94 or the switching operation of the lock up clutch 92, the target valve timing VTTGT is prohibited from being changed, and the target valve timing VTTGT at the time is held.

Thus, the operation of the VVT 27 during the period is stopped, and the valve timing is unchanged and maintained at the present value, so that the valve timing can be prevented from changing because of temporary change in the engine speed or the engine load associated with the transmission operation or lock up clutch switching operation. Therefore, an engine output fluctuation caused by unnecessary change in the valve timing can be prevented, and the torque shock at the time of transmission or lock up clutch switching operation can be restrained. As a result, the controllability can be improved.

Second Embodiment

Figure 16:
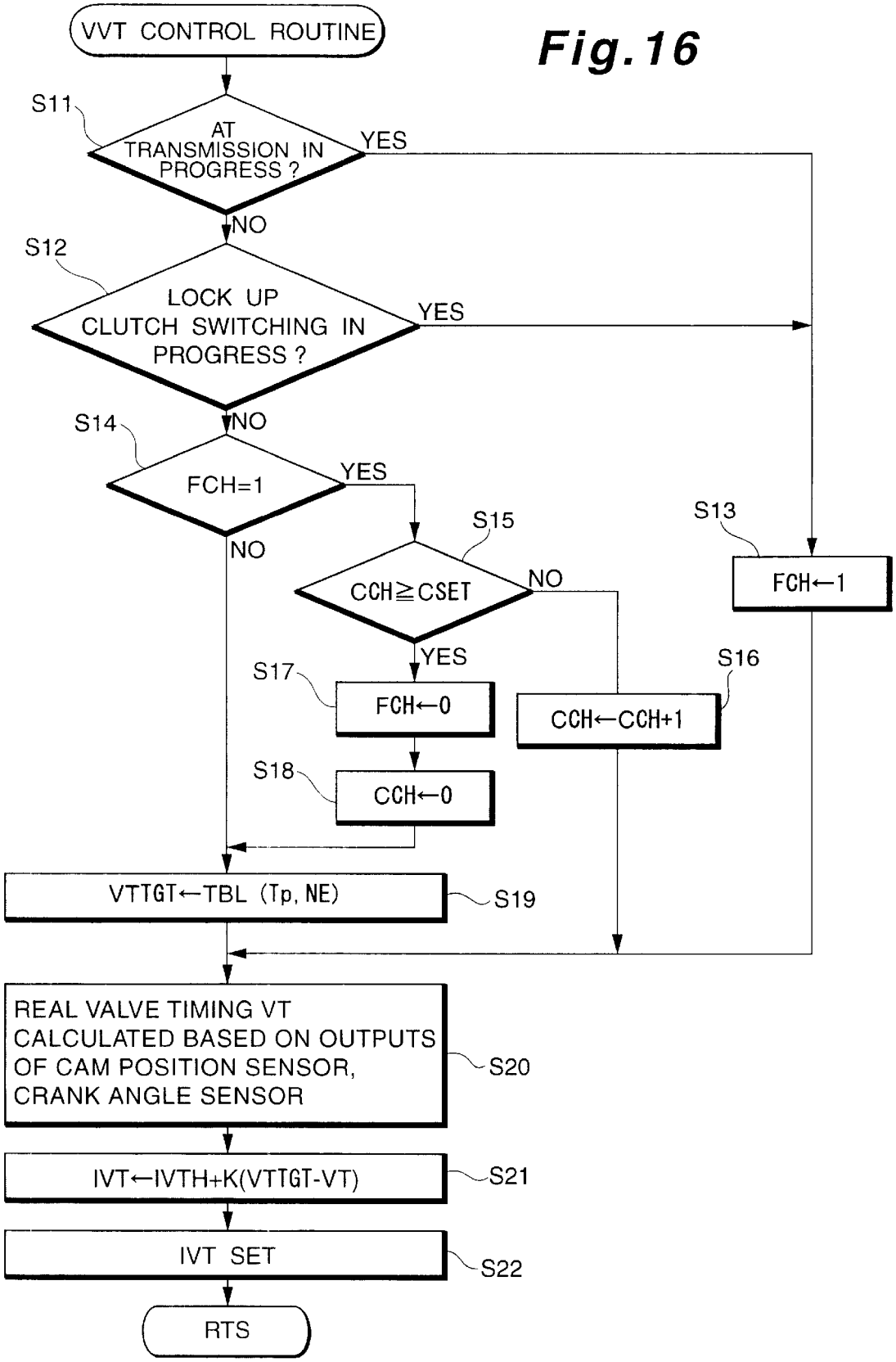
FIG. 16 is a flow chart for use in illustration of a variable valve timing control routine according to a second embodiment of the present invention.

Control according to a second embodiment of the present invention will be now described. According to the embodiment, after a transmission switch signal is output, a hydraulic pressure control valve and a switching valve are switched to allow a clutch and a brake to operate, and transmission or lock up clutch switching is performed, so that response delay time required until the end of the switching is compensated. FIG. 16 is a flow chart thereof. Note that since the structure of the engine to which the control according to the second embodiment is applied is the same as that of the first embodiment, and therefore a description thereof is not provided. The process similar to the routine shown in FIG. 13 is not detailed.

The routine shown in FIG. 16 is also executed in the ECU 60 for each predetermined time period (such as 10 msec) when the starter switch (not shown) is turned on and the engine 1 is activated.

First in steps S11 and S12, control data read from the TCU 90 is used to determine the transmission operation of the automatic transmission 94 and the switching operation of the lock up clutch 92. If it is determined based on the switching of the control data value that the automatic transmission 94 is in the process of transmission operation, or the lock up clutch 92 is in the process of switching, the control proceeds from the corresponding step to step S13, and an update prohibition flag FCH indicating update prohibition of the target valve timing VTTGT is set (FCH←1), and the control jumps to step S20 without updating the target valve timing VTTGT.

Herein, the update prohibition flag FCH is a flag indicating update prohibition of the target valve timing VTTGT, and cleared by initial setting. The update prohibition flag FCH is set in response to the start of transmission operation by the automatic transmission 94 or the start of switching operation by the lock up clutch 92 and maintained in the set state for a predetermined time period until a response delay by a clutch or brake in the automatic transmission 94 or a response delay by the lock up clutch 92 is compensated, and the transmission operation of the automatic transmission 94 or the switching operation of the lock up clutch 92 is completed by a process which will be described later.

In step S20, the real valve timing VT is calculated based on the outputs of the cam position sensor 46R (46L) and the crank angle sensor 44, and in the following step S21, the control current value IVT for the OCV 36R (36L) is calculated from the target valve timing VTTGT, the real valve timing VT, and the held current value IVTH. The control current value IVT is set in step S22 and the control exits the routine.

Thus, in response to the transmission operation of the automatic transmission 94 or the switching operation of the lock up clutch 92, the updating of the target valve timing VTTGT is interrupted, so that the operation of the VVT 27 is stopped.

If it is determined in steps S11, S12 based on the control data from the TCU 90 that the automatic transmission 94 is not in the process of transmission operation and the lock up clutch 92 is not in the process of switching, the control proceeds to step S14 and the update prohibition flag FCH is referred to.

When the update prohibition flag FCH is set, the control proceeds to step S15, and a count value CCH is compared to a preset value CSET. Here, the count value CCH is produced by counting time after the start of the transmission operation of the automatic transmission 94 based on the switching of the transmission control data, or the start of switching of the lock up clutch 92 based on the switching of the lock up control data. Herein, the set value CSET is set to stop setting the target valve timing VTTGT based on the engine operation state, and hold the target valve timing at the time for a predetermined time period after the transmission control data or the lock up clutch control data is switched, in order to compensate for response delay time in the transmission operation or the lock up clutch switching. The value is provided as fixed data by previously obtaining a correct value by simulation, an experiment or the like, set for a time value (such as 1 to 3 sec) slightly longer than the response delay time described above, and stored in the ROM 62.

In step S15, if CCH>CSET holds, and the time after the start of the transmission operation of the automatic transmission 94 based on the switching of the transmission control data or the time after the start of the switching of the lock up clutch 92 based on the switching of the lock up clutch control data has not reached a predetermined time period determined by the set value CSET to compensate for the response delay, the control proceeds to step S16, increments the count value CCH and jumps to step S20. During this period, the target valve timing VTTGT is held and not updated, and the control exits the routine via steps S20 to S22.

When the count value CCH reaches the set value CSET, the control proceeds from step S15 to step S17, and in steps S17, S18, the update prohibition flag FCH and the count value CCH are cleared. Then, the control proceeds to step S19, resumes updating the target valve timing VTTGT, and the target valve timing VTTGT is set based on the engine operation state represented by the engine speed NE and the basic fuel injection pulse width Tp as the engine load. Then, by the feedback control by the process from steps S20 to S22, the real valve timing VT is converged to the target valve timing VTTGT.

Thereafter, the update prohibition flag FCH has been cleared and therefore the control proceeds to step S19 through steps S11, S12 and S14, unless the automatic transmission 94 is in the process of the transmission operation and the lock up clutch 92 is in the process of switching. Then, the target valve timing VTTGT based on the engine operation state is set, and the feedback control is performed by the process from steps S20 to S22, the real valve timing VT is converged to the target valve timing VTTGT, and the valve timing adapted to the engine state is quickly regained.

Thus, according to the embodiment, in order to compensate for the response delay by a hydraulic pressure control valve or a switch valve and a clutch or a brake in the automatic transmission 94 operating by the supply of hydraulic pressure created by switching of the hydraulic pressure control valve and the switch valve, the target valve timing VTTGT is prohibited from being changed during the response delay time, and the target valve timing VTTGT at the time is held. Therefore, the valve timing can be surely prevented from being changed in response to a temporary fluctuation in the engine speed and the engine load caused by the transmission operation or the lock up clutch switching operation, and the torque shock can be surely restrained to improve the controllability.

The invention by the inventors has been described in detail by referring to the embodiments of the invention, while the present invention is not limited to the embodiments described above, and can be subjected to various modifications within the scope of the invention.

For example, in the above described embodiments, the engine is provided with a variable valve timing mechanism only on the intake camshaft side, while the present invention is not limited to this structure and at least one of an intake camshaft and an exhaust camshaft needs only have a variable valve timing mechanism.

Note that the engine to be used needs only be an engine with a variable valve timing mechanism and have at least one camshaft interlocked with the crankshaft. The engine does not have to be a DOHC (double overhead camshaft) type engine, or is not limited to a horizontally opposed engine.

Furthermore, the transmission means between the crankshaft and the camshaft is not limited to the timing belt type means according to the embodiments, and for example other appropriate means such as chain type or gear type means may be employed.

In addition, in the described embodiments, the invention is applied to the engine with a serially variable valve timing mechanism, but the invention is not limited to this, and may be applied to engines with a variable valve timing mechanism selectively switching between a low speed cam and a high speed cam as disclosed by Japanese Patent Laid-Open Publication No. Hei. 7-11981, or various other kinds of engines with a variable valve timing mechanism.

Also according to the embodiments described above, a torque converter with a lock up clutch is provided and in the process of at least one of the transmission operation of the automatic transmission and the switching operation of the lock up clutch, the target valve timing is prohibited from being updated to stop the operation of the variable valve timing mechanism. However, the present invention is not limited to this structure and is applicable to those without a lock up clutch. In this case, only during the transmission operation of the automatic transmission, the operation of the variable valve timing mechanism should be stopped. For the method of stopping the operation of the variable valve timing mechanism, appropriate processing may be employed, and for example the value of the control current value itself may be held.

Furthermore, according to the embodiments described above, cooperative control by the two-way communication between the ECU and the TCU is applied, but the present invention is not limited to the structure, and each control map as shown in FIGS. 14 and 15 for example may also be provided to the ECU. Whether or not the automatic transmission is in the process of the transmission operation or whether or not the lock up clutch is in the process of the switching may be determined based on the data in the ECU itself.

As in the foregoing, according to the first aspect of the present invention, since the operation of the variable valve timing mechanism is stopped during the transmission operation of the automatic transmission, an engine output fluctuation caused by change in the valve timing in association with the transmission operation of the automatic transmission can be prevented. As a result, the torque shock in the transmission operation can be restrained and the controllability can be improved.

According to the second aspect of the present invention, the operation of the variable valve timing mechanism is stopped during the transmission operation of the automatic transmission or the switching operation of the lock up clutch. As a result, without mentioning during the period of transmission operation of the automatic transmission, an engine output fluctuation caused by change in the valve timing in association with the switching of the lock up clutch can be prevented. Therefore, at the time of switching the lock up clutch, an engine output fluctuation in association with unnecessary change in the valve timing can be prevented to restrain the torque shock.

According to the third aspect of the present invention, data from the transmission control means for controlling the automatic transmission and the lock up clutch based on the operation state of the engine and the vehicle is input, and after the transmission control data and the lock up clutch control data is switched, the operation of the variable valve timing mechanism is stopped for a predetermined time period, and therefore in addition to the effect of the second aspect of the invention, a response delay by a clutch or a brake in the automatic transmission or a response delay by the switching of the lock up clutch is compensated. Therefore, the torque shock can be surely restrained and the controllability can be significantly improved.

According to the fourth aspect of the present invention, the operation of the variable valve timing mechanism is stopped, and the target valve timing set based on the engine operation state is prohibited from being updated, and the operation of the variable valve timing mechanism is stopped by holding the target valve timing at the time, and therefore in addition to the effects of the first to third aspects of the invention, the control can be very readily incorporated into the conventional control.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A control device for a variable valve timing mechanism of an engine installed in a vehicle having an automatic transmission, comprising:

valve timing control means for controlling an operation of said variable valve timing mechanism based on an engine operation state, and stopping the operation of said variable valve timing mechanism when said automatic transmission is in the process of transmission operation.

2. The control device according to claim 1, wherein a torque converter having a lock up clutch capable of mechanically connecting an input side and an output side of said automatic transmission is provided between said engine and said automatic transmission, and said valve timing control means stops the operation of said variable valve timing mechanism in at least one of a case when said automatic transmission is in the process of transmission operation and a case when said lock up clutch is in the process of switching.

3. The control device according to claim 2, further comprising:

transmission control means for controlling said automatic transmission and said lock up clutch based on the operation state of the engine and the vehicle, wherein said valve timing control means is provided with data fed from the transmission control means and stops the operation of said variable valve timing mechanism for a predetermined time period after transmission control data or lock up clutch control data is switched.

4. The control device according to claim 1, wherein said valve timing control means prohibits a target valve timing set based on the engine operation state from being updated, and stops the operation of said variable valve timing mechanism.

* * * * *